US006397722B1

(12) United States Patent
Eddington

(10) Patent No.: US 6,397,722 B1
(45) Date of Patent: Jun. 4, 2002

(54) VARIABLE TORQUE ACCOMMODATING, PRESSURE FLUID DRIVEN, TRANSMISSIONLESS ENGINE

(76) Inventor: George D. Eddington, 240 W. 500 North, LaVerkin, UT (US) 84745

( * ) Notice: Subject to any disclaimer, the term of this patent is extended or adjusted under 35 U.S.C. 154(b) by 0 days.

(21) Appl. No.: 08/946,609

(22) Filed: Oct. 7, 1997

(51) Int. Cl.[7] ..... F01B 1/00
(52) U.S. Cl. ..... 91/170 R; 92/136
(58) Field of Search ..... 91/186, 37, 39, 91/275, 170 R, 172, 174, 187, 508, 519, 521; 92/136, 138; 123/90.16

(56) References Cited

U.S. PATENT DOCUMENTS

| | | | | | |
|---|---|---|---|---|---|
| 712,855 | A | * | 11/1902 | Schmick | 92/136 X |
| 950,866 | A | * | 3/1910 | Poulson | 92/136 X |
| 1,335,764 | A | * | 4/1920 | Sullivan | 92/138 X |
| 2,750,934 | A | * | 6/1956 | May | 92/136 X |
| 3,014,463 | A | * | 12/1961 | Krohm | 92/138 X |
| 3,538,814 | A | * | 11/1970 | Fisher | 91/39 |
| 3,554,097 | A | * | 1/1971 | Karpowiez | 92/136 |
| 3,613,511 | A | | 10/1971 | Eddington | 91/502 |
| 3,973,445 | A | * | 8/1976 | Ballard | 91/275 |
| 4,074,611 | A | * | 2/1978 | Hereth | 91/186 |
| 4,401,010 | A | | 8/1983 | Eddington et al. | 91/273 |
| 4,555,903 | A | * | 12/1985 | Heaton | 92/136 X |
| 5,007,655 | A | | 4/1991 | Hanna | 280/250 |
| 5,012,643 | A | * | 5/1991 | Higami | 91/275 |
| 5,117,739 | A | | 6/1992 | Maher et al. | 92/2 |
| 5,287,829 | A | * | 2/1994 | Rose | 92/175 X |
| 5,570,621 | A | * | 11/1996 | Kabasin | 91/363 R |
| 5,715,724 | A | * | 2/1998 | Crout et al. | 91/248 X |
| 5,809,955 | A | * | 9/1998 | Murata et al. | 92/121 X |

* cited by examiner

*Primary Examiner*—John E. Ryznic
(74) *Attorney, Agent, or Firm*—Mallinckrodt & Mallinckrodt

(57) ABSTRACT

A pressure fluid driven piston and cylinder engine capable of providing high torque output at any engine speed for direct connection to a vehicle or machine to be driven. The engine may be used for any purpose, but is especially advantageous for powering an automotive vehicle. The engine does not require a transmission due to its ability to provide, in itself, a high torque at any engine speed and the ability to provide forward and reverse drive and neutral and park functions. The engine has at least a pair of piston and cylinder power units with pistons which move in an opposing manner to transmit power from elongate gear racks, respectively, on the piston rods to an outer pinion gear portion of respective conventional roller clutches. The roller clutches, in turn, change the reciprocating movement of the power units into unidirectional rotation of the drive shaft. Constant leverage is exerted by the pistons on the drive shaft throughout their power strokes by use of this gear and rack arrangement. Engine torque output is controlled by regulating the portion of each piston power stroke during which the intake valve is open, by selecting which one of preferably four intake valve settings is activated at a given instant, analogous to shifting gears in an automotive transmission. The reverse engine function is achieved by adding a second pair of power unit having a cylinder and piston and cooperative reversing unit coupled to oppositely rotating roller clutches on a separate drive shaft and by selectively engaging one or the other drive shaft for power takeoff. A clutch and a differential are disclosed for the engine or for use otherwise.

21 Claims, 22 Drawing Sheets

VARIABLE TORQUE ACCOMMODATING, PRESSURE FLUID DRIVEN, TRANSMISSIONLESS ENGINE

BACKGROUND OF THE INVENTION

1. Field

Figure 1:
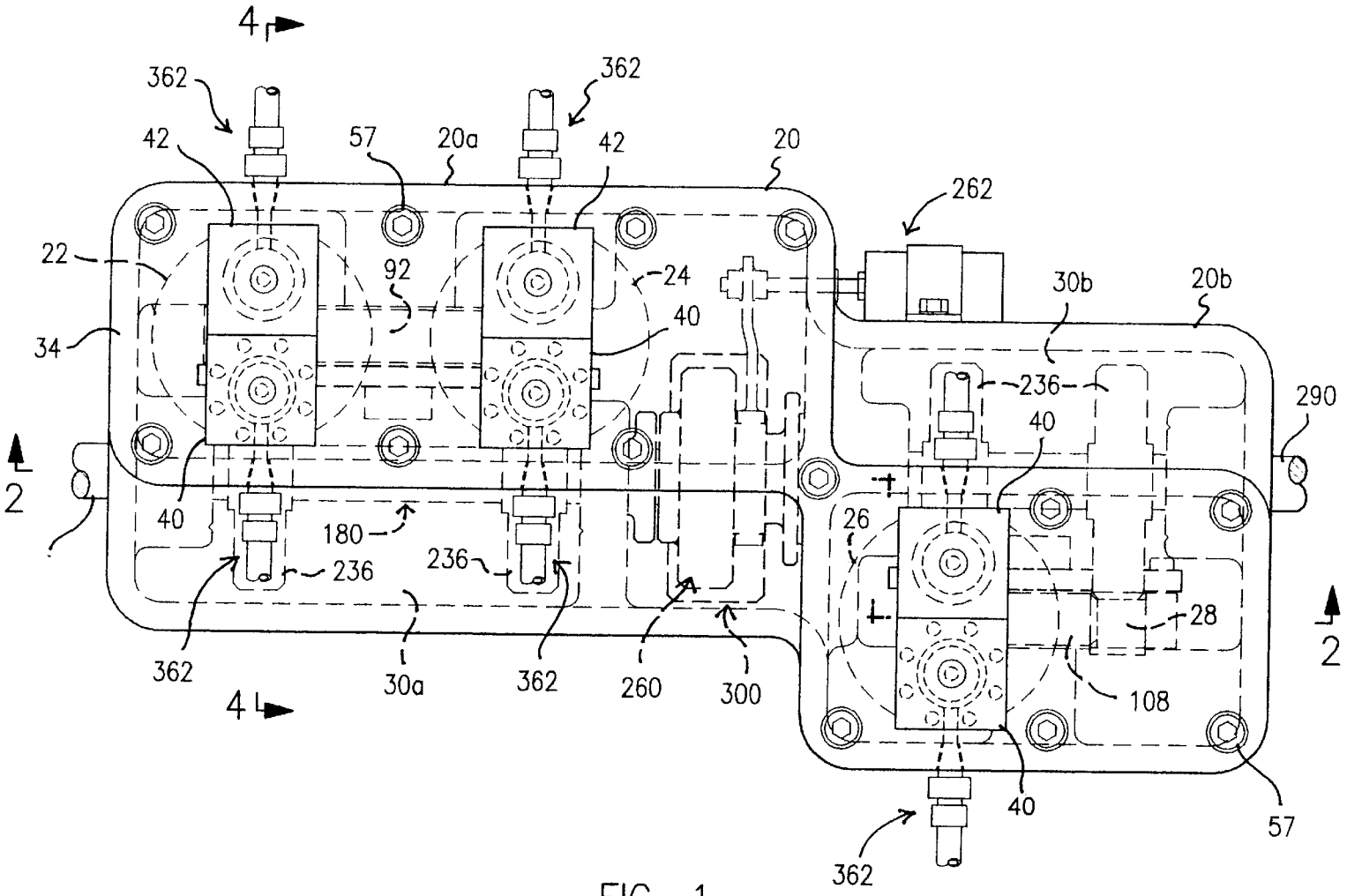

The invention is in the field of positive displacement, pressure fluid powered, piston and cylinder engines capable of directly accommodating varying power needs of an automotive vehicle or other motivated device, without the customary use of a separate power transmission mechanism.

2. State of the Art

A variable piston stroke and variable cylinder capacity engine, which can directly accommodate varying power needs without the usual separate automobile transmission, is disclosed in my U.S. Pat. No. 4,401,010 of Aug. 30, 1983. However, there is still need for a relatively simple engine providing smooth, high torque output even at relatively slow engine speeds, as well as high overall power output and the typical functions of an automobile transmission, namely forward and reverse drives, and the neutral and park functions.

SUMMARY OF THE INVENTION

In the making of the present invention, a principle objective was to provide an engine which requires no transmission and which is capable of providing a high torque output independently of engine speed, so the engine can be coupled directly to a load, such as a wheel or wheels of an automotive vehicle. In accordance therewith, I have taken advantage of well-known roller clutches for converting fixed piston stroke, reciprocating motion in opposite directions to unidirectional rotary motion of a power output drive shaft assembly. Power output of the engine is varied by controlling the input volume in addition to conventional pressure regulation, of a pressure fluid, such as steam or a compressed gas, to the cylinders of a pair or pairs of oppositely acting, piston and cylinder power units of the particular engine concerned.

Other objectives of the invention were to produce a piston and cylinder type of engine, which can provide the typical transmission functions of forward and reverse drives and neutral and park functions, and with smooth torque output continuously throughout the full 360 degrees of a rotation of an output drive shaft arrangement, particularly at low engine speeds; to optimize the leverage of a the pistons in rotating the drive shaft of such an engine during reciprocative strokes of the respective pistons of the power units for overall power output; to optimize the volume of a pressurized fluid such as steam or a compressed gas introduced into the cylinders such an engine so as to allow the use of a relatively small condenser when the pressure fluid is steam or other heated fluid; and to provide a simpler engine of the type concerned at an economically favorable cost.

The use of roller clutches for converting opposite reciprocative motions of the pistons of a piston and cylinder power unit pair or pairs in an engine to unidirectional rotary motion is best accomplished in accordance with the invention by the piston of each power unit of the pair or pairs thereof having a piston rod with coextensive sets of cooperating and of oppositely facing gear racks extending longitudinally thereof, one gear rack from each power unit of the pair or pairs confronting a gear rack of the other power unit of the pair or pairs, with a timing gear interengaging the two confronting gear racks. The remaining gear racks of each set interengage a pinion gear of the corresponding roller clutches which unidirectionally turn a first drive shaft, the extent of torque output being varied by controlling the volume of pressure fluid introduced into the cylinders of such power units, with specific pre-determined volumes substituting for the shifting of gears in the usual transmission of an automotive vehicle. Thus, for example, in an automotive vehicle, when the volume of pressure fluid required to operate the engine at start-up or under heavy load is one hundred percent of the volumetric capacity of the cylinders of a drive unit pair, that is the volume of pressure fluid input for the time required to cope with the load, thus corresponding to low, or first gear in the usual transmission. When the volume of pressure fluid required to cope with the load corresponding to second gear in the usual transmission is only thirty percent, that is the volume of pressure fluid input for the time required. When the volume of pressure fluid required to cope with the load corresponding to third gear in the usual transmission is only twenty percent, that is the volume of pressure fluid input for the time required. When the volume of pressure fluid required to maintain top vehicle speed corresponding to fourth or high gear in the usual transmission, as on a level road surface, is only ten percent, the volume of pressure fluid is cut down to ten percent for the time that this condition remains. The choice of ten percent, twenty percent, thirty percent, or one hundred percent volume of pressure fluid may be controlled as by a lever or switch mounted on an automotive vehicle steering column. The pressure fluid is preferably steam due to its high expandability, however, other liquids which may be vaporized, or even pressurized gases such as air, may be used.

Forward and reverse drives and neutral and park functions are provided for automotive applications, such as in directly powering the wheels of an automotive vehicle. The reverse drive function is achieved by incorporating a third, and a pistonless fourth power unit, or reversing unit, along with the usual pair of unidirectional forward power units, and a second pair of oppositely rotating roller clutches which engage a second drive shaft so as to rotate it oppositely to the first drive shaft. These first and second drive shafts are selectively coupled, as by means of a sliding clutch and gear assembly, through a geared differential mechanism, to a pair of jackshafts, each of which have one wheel of the vehicle attached for rotation therewith, the engine thus effecting the several functions of the usual automotive transmission mechanism. The engine may also incorporate a foot-actuated, pressure fluid throttle valve to vary the pressure of the pressure fluid entering the engine, similar to using the throttle pedal on an automotive vehicle.

THE DRAWINGS

Figure 2:
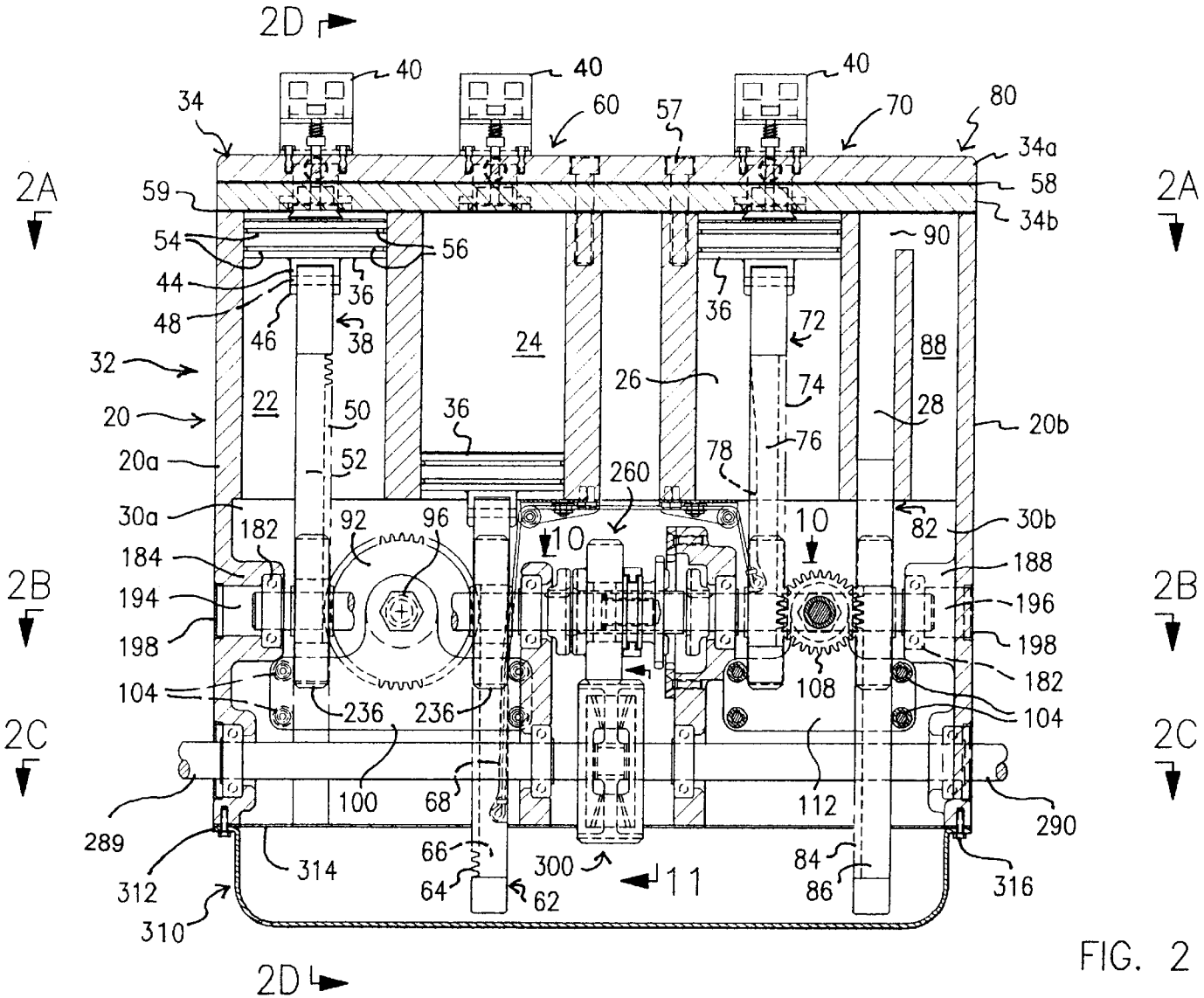
Figure 2A:
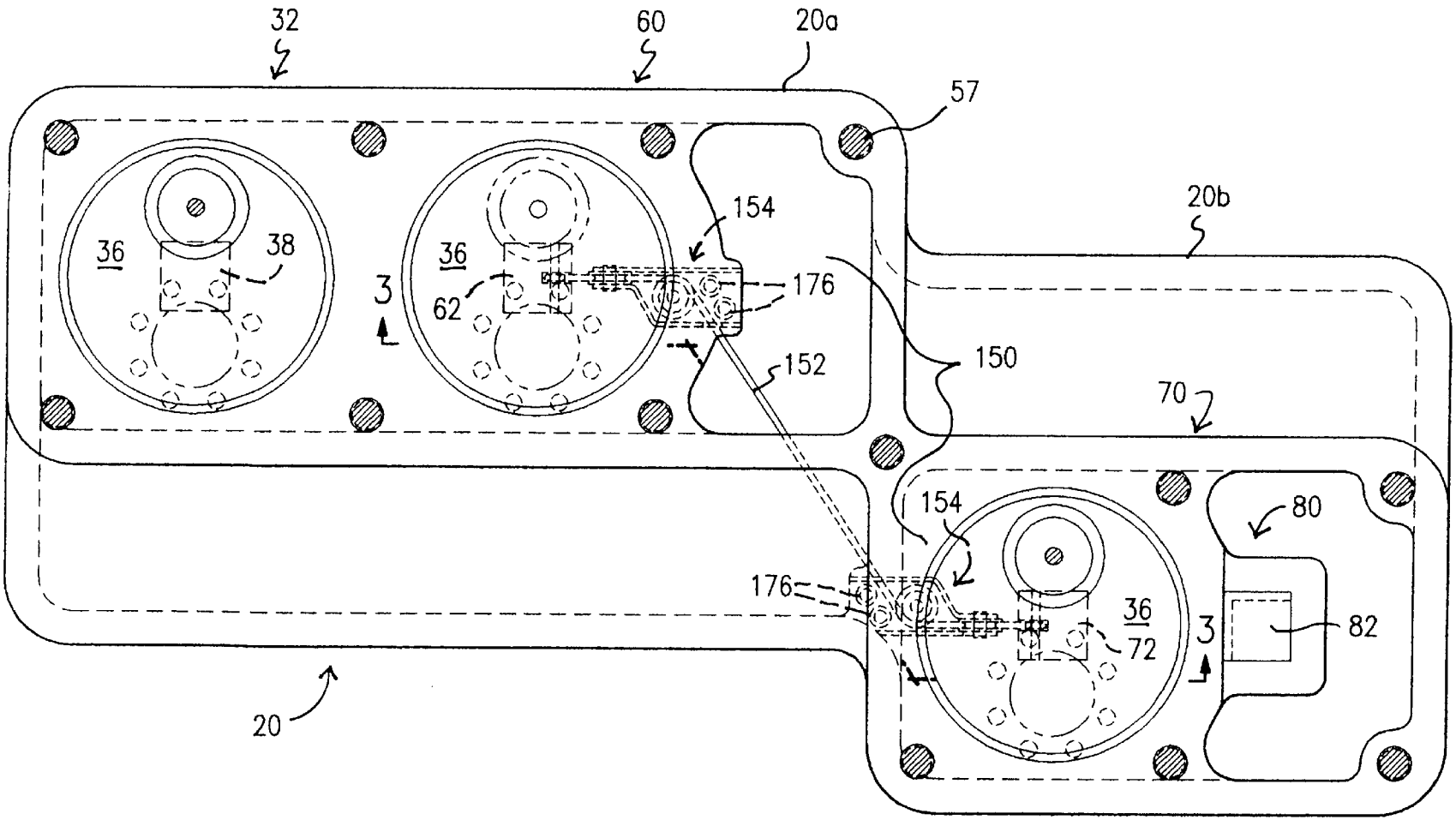

The best mode presently contemplated for carrying out the invention is illustrated in the accompanying drawings, in which:

FIG. 1 is a plan view, with internal structure and mechanism shown by broken lines, of a first embodiment of the invention for automotive use, the engine having three power units, a pistonless reversing unit, with forward and reverse drives, and neutral and park functions;

FIG. 2, a view in longitudinal vertical section taken on the line 2—2 of FIG. 1 and drawn to a reduced scale;

FIG. 2A, a view in longitudinal horizontal section taken on the line 2A—2A of FIG. 2.

Figure 2B:
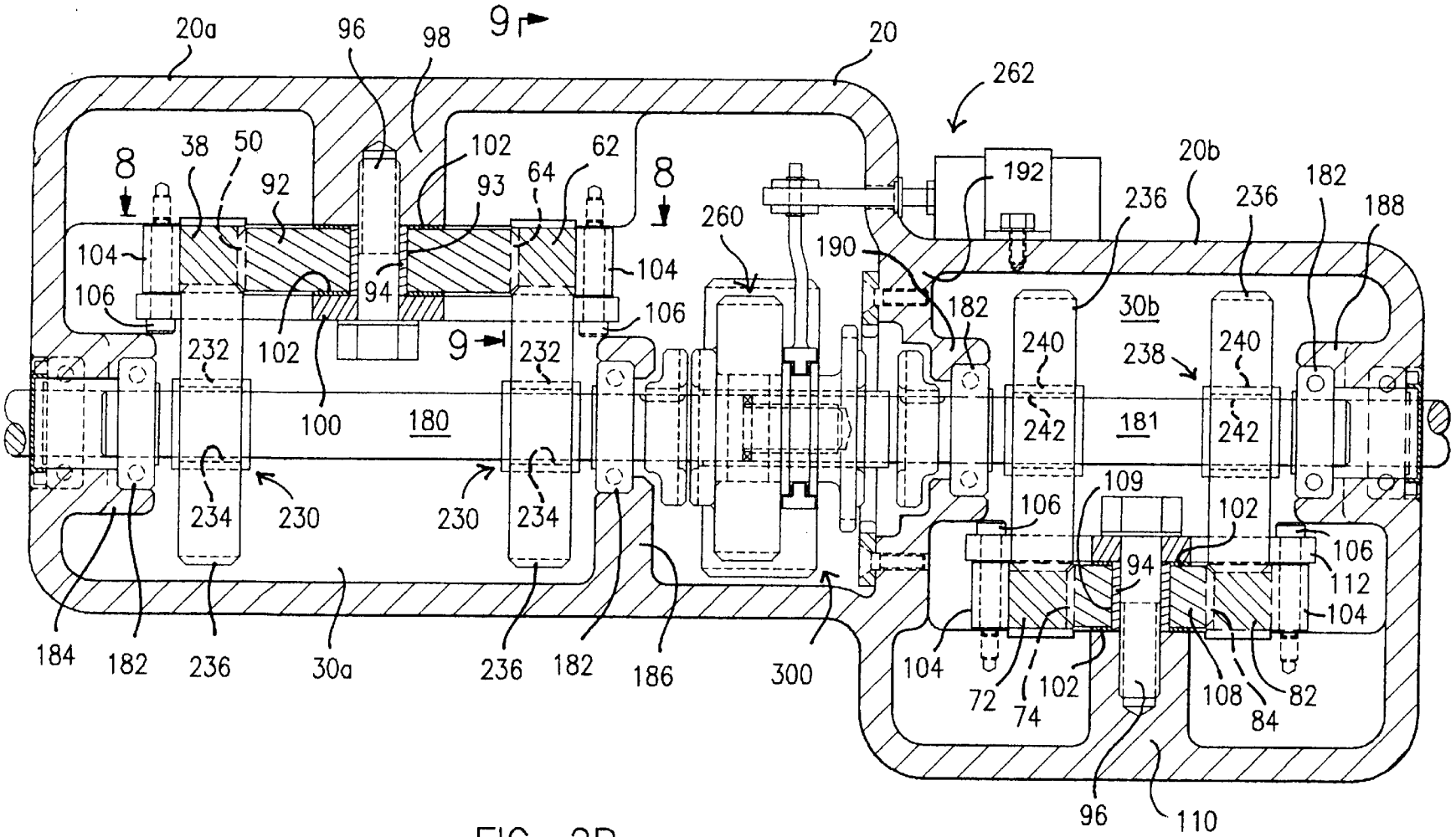

FIG. 2B, a view in longitudinal horizontal section taken on the line 2B—2B of FIG. 2.

Figure 2C:
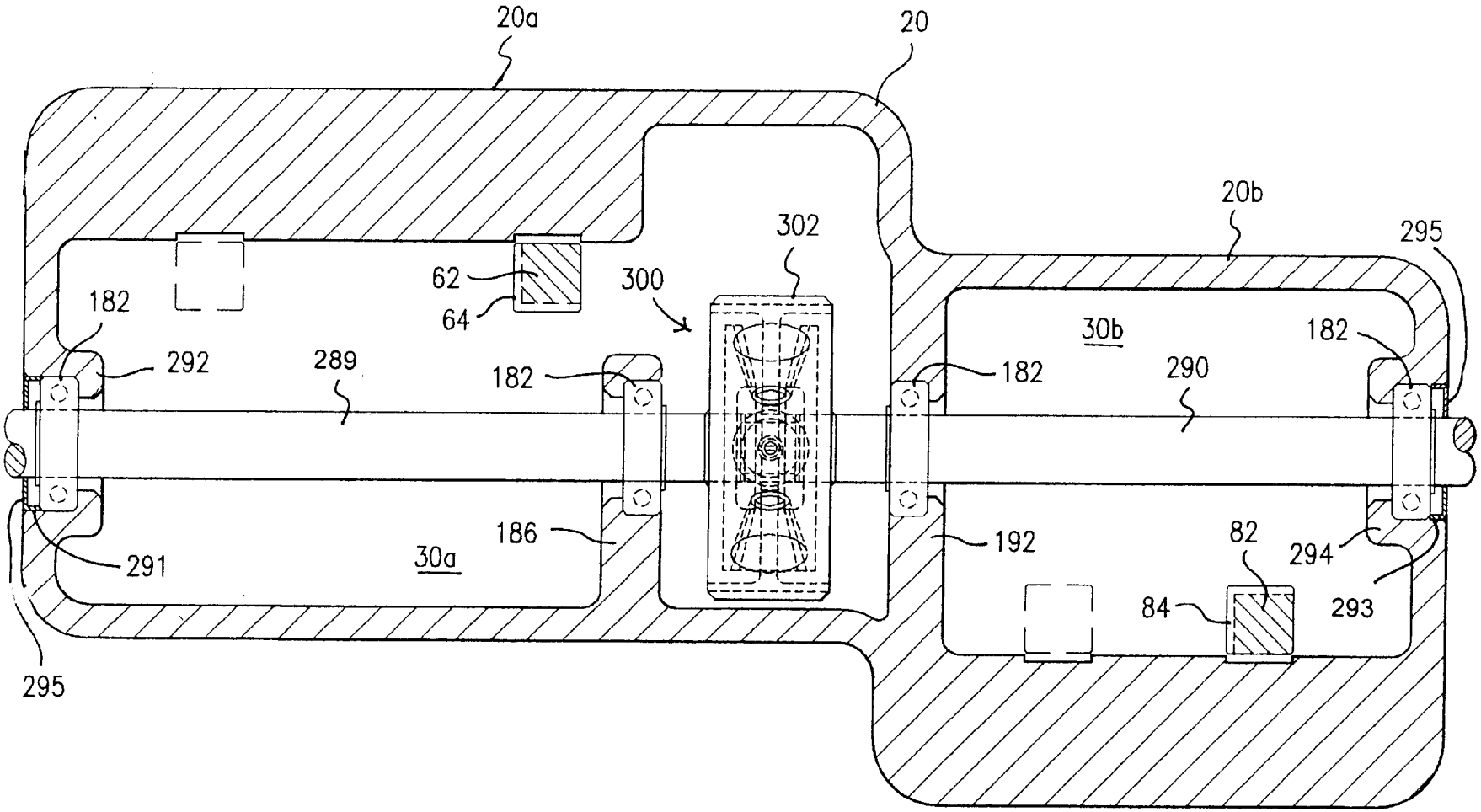

FIG. 2C, a view in longitudinal horizontal section taken on the line 2C—2C of FIG. 2.

Figure 2D:
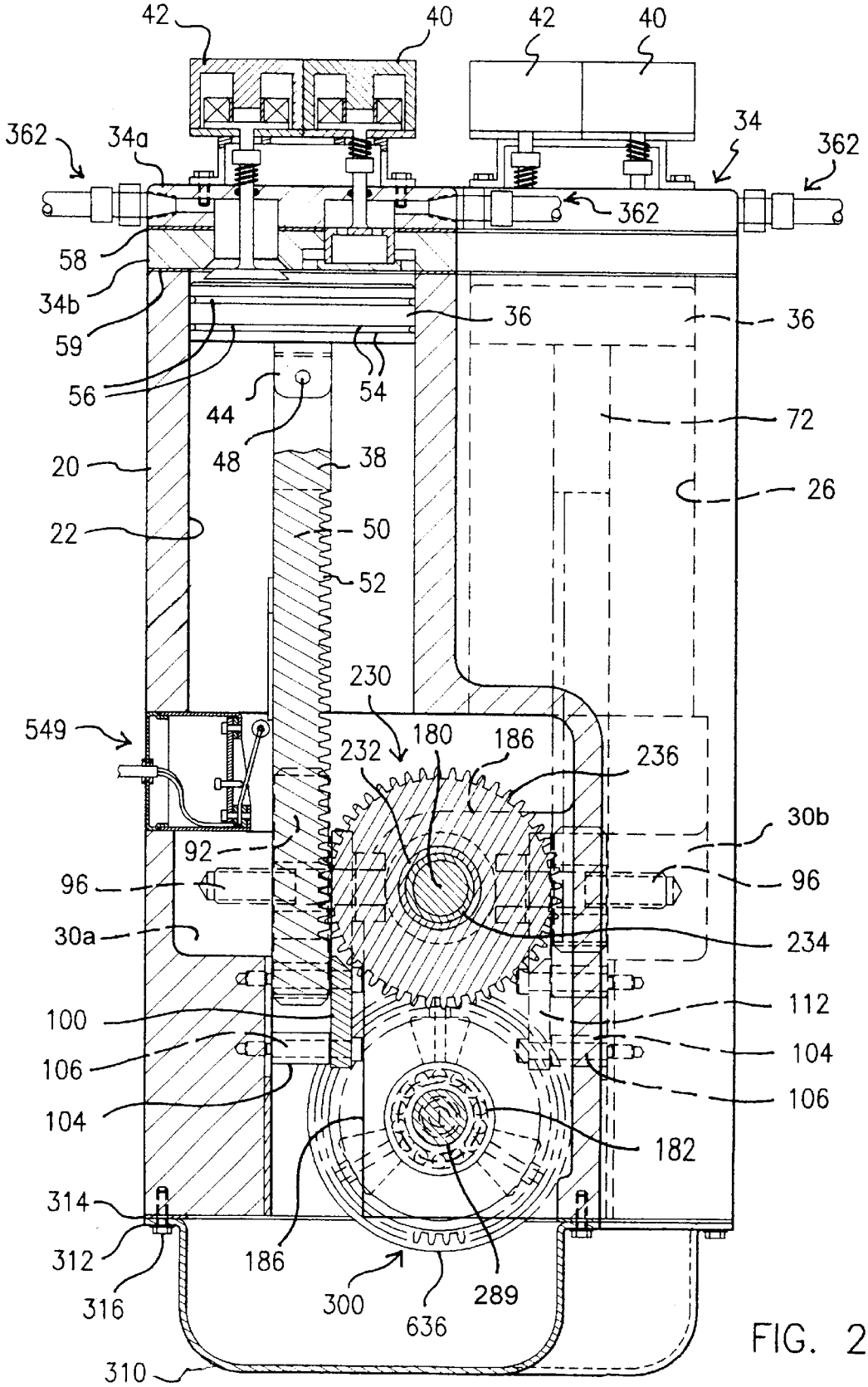

FIG. 2D, a view in lateral vertical section taken on the line 2D—2D of FIG. 2.

FIG. 3, a fragmentary view in longitudinal vertical section taken on the line 3—3 of FIG. 2A and drawn to a larger scale showing the piston and cylinder pair of the second and third power units in one extreme position, and showing the synchronizing or coupling system connecting the power units.

Figures 3A, 3C:
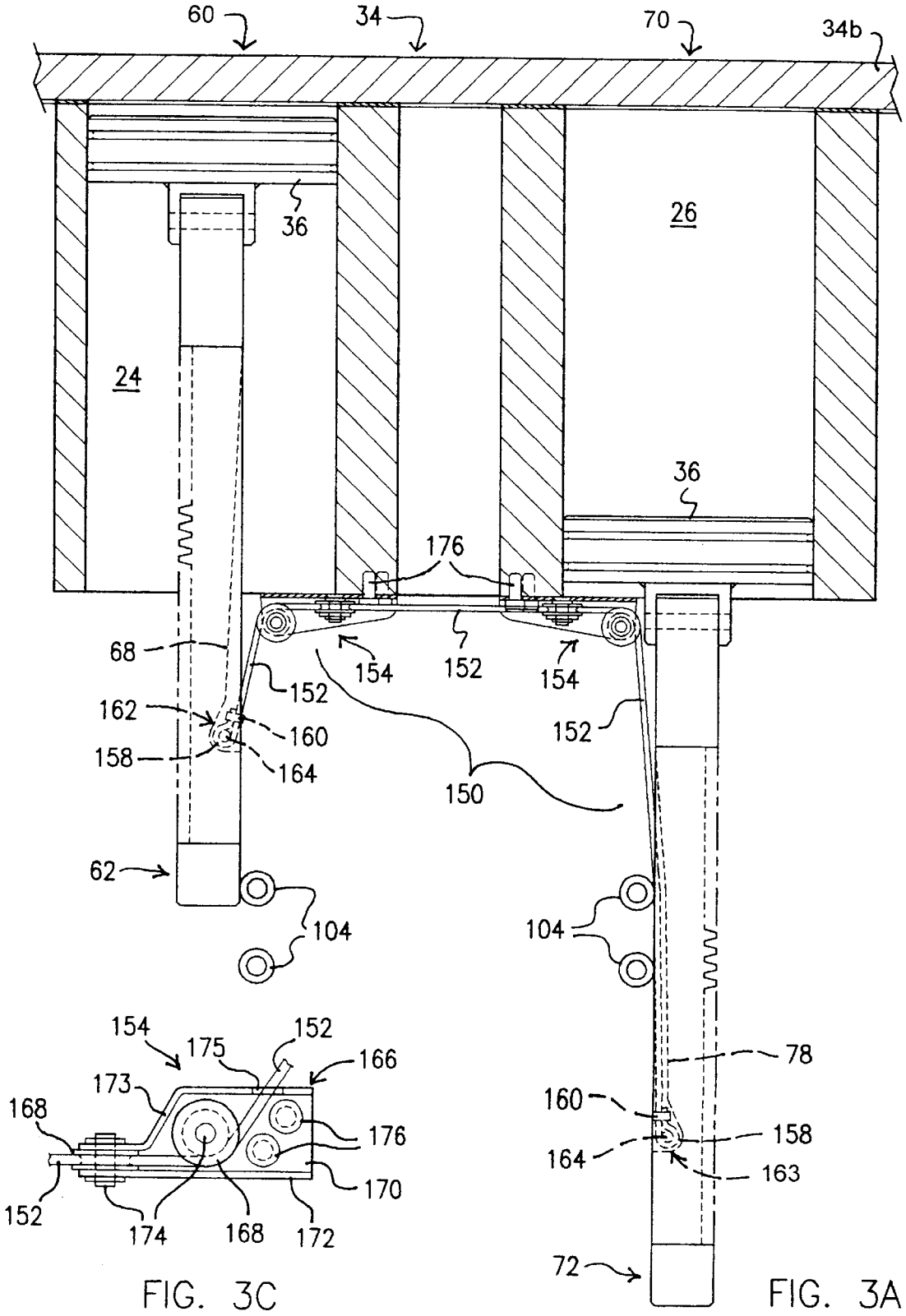
Figures 3B, 3D:
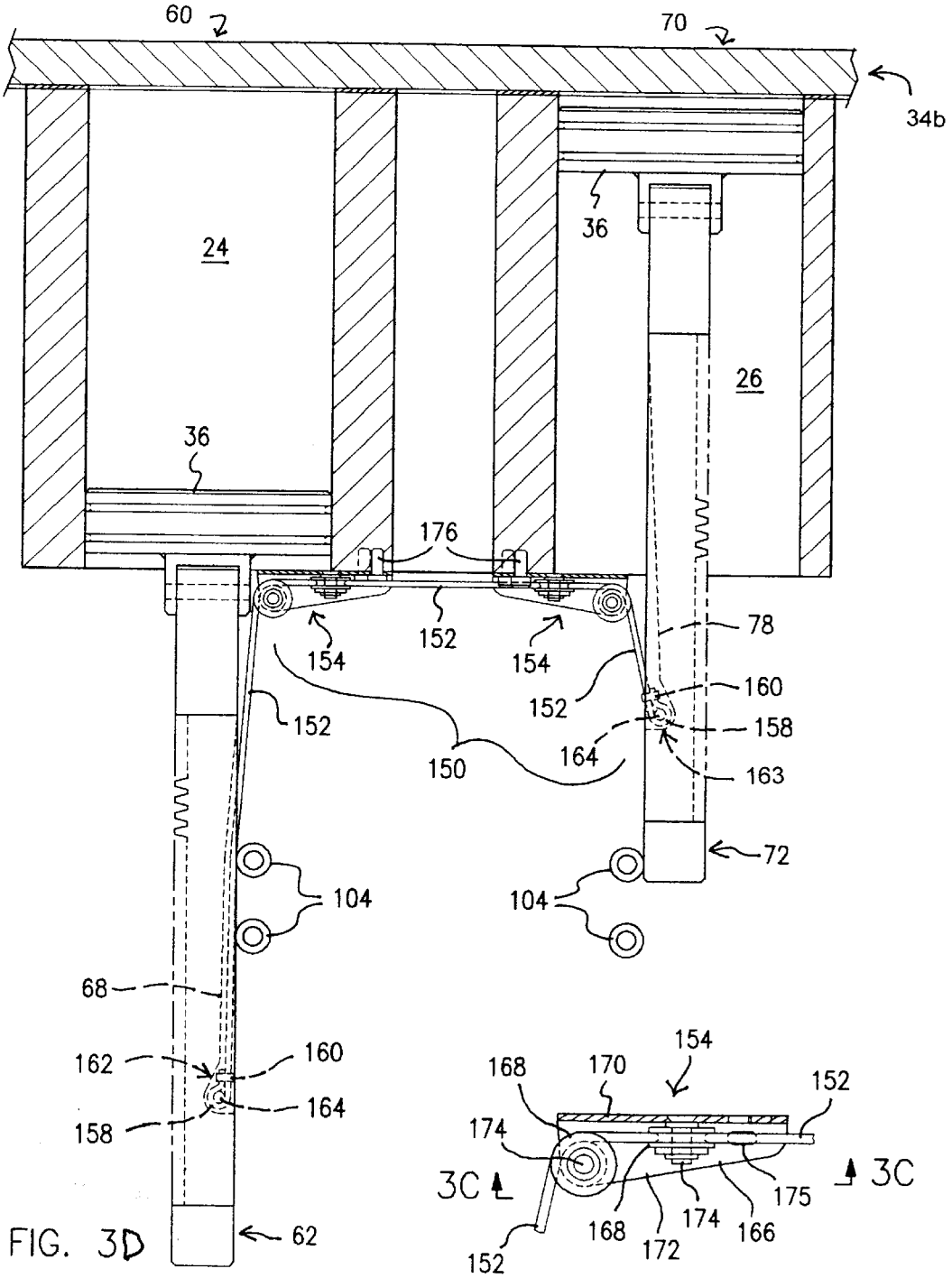

FIG. 3A, a corresponding view but having the piston and cylinder pairs in the opposite extreme positions;

FIG. 3B, a partially broken view drawn to a larger scale showing a pulley assembly for exhausting the cylinder of the third power unit.

FIG. 3C, a view in bottom plan taken on line 3C—3C of FIG. 3B showing the pulley assembly.

Figure 4:
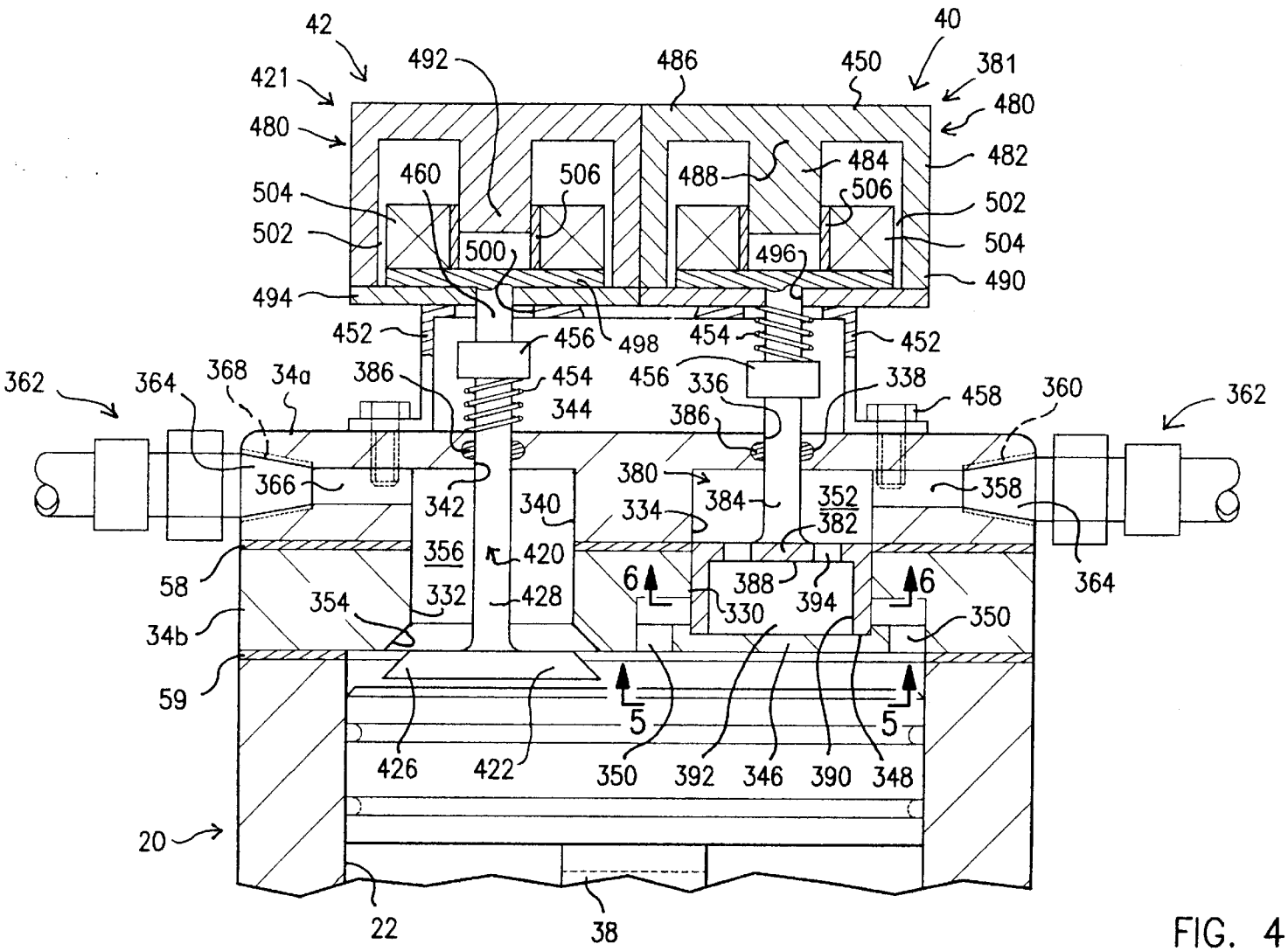
Figure 7:
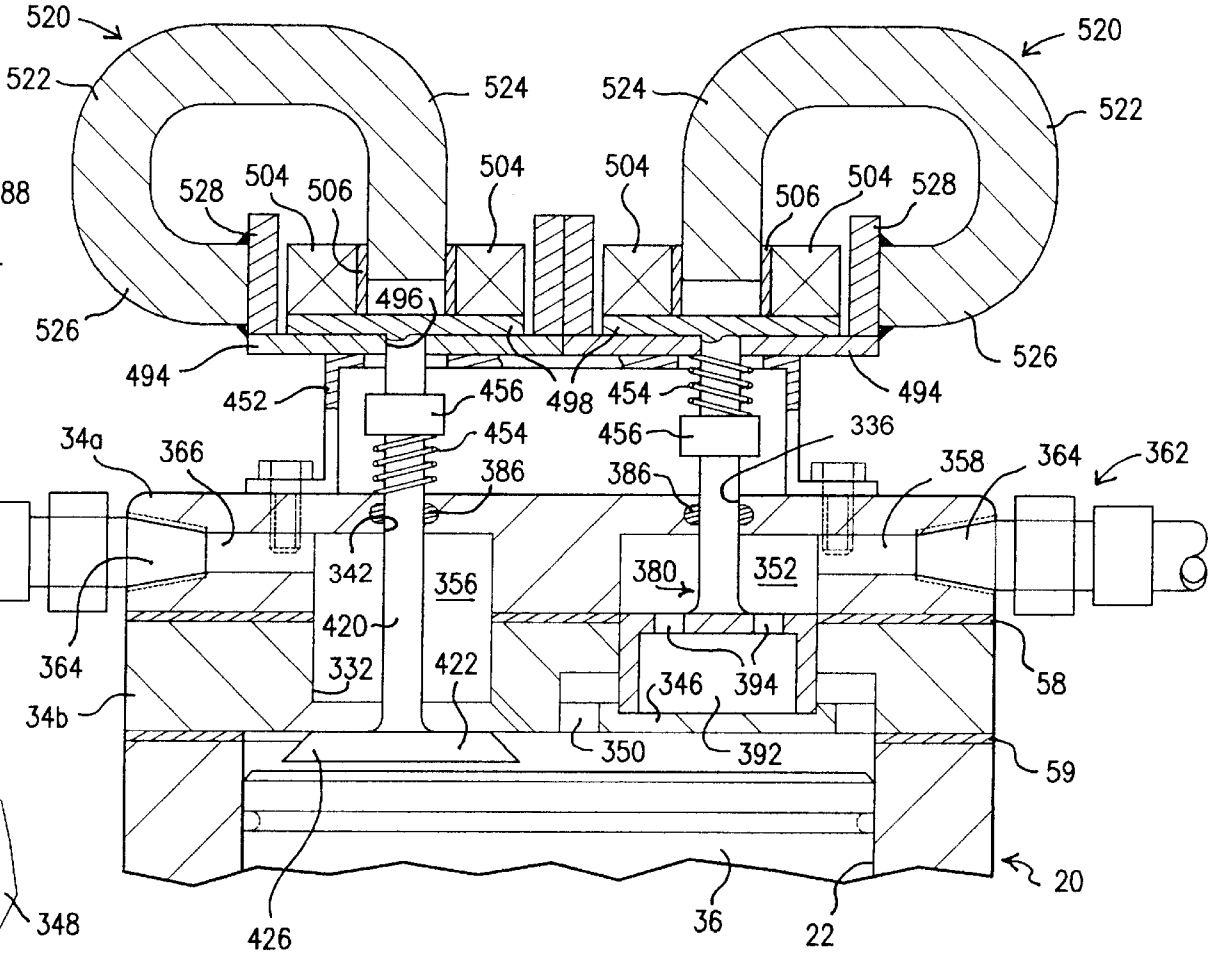
Figure 6:
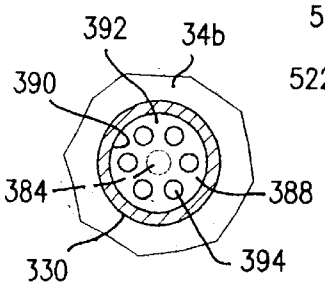
Figure 5:
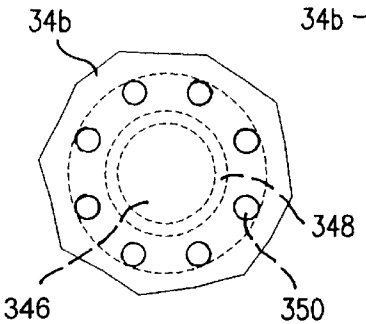
Figure 8:
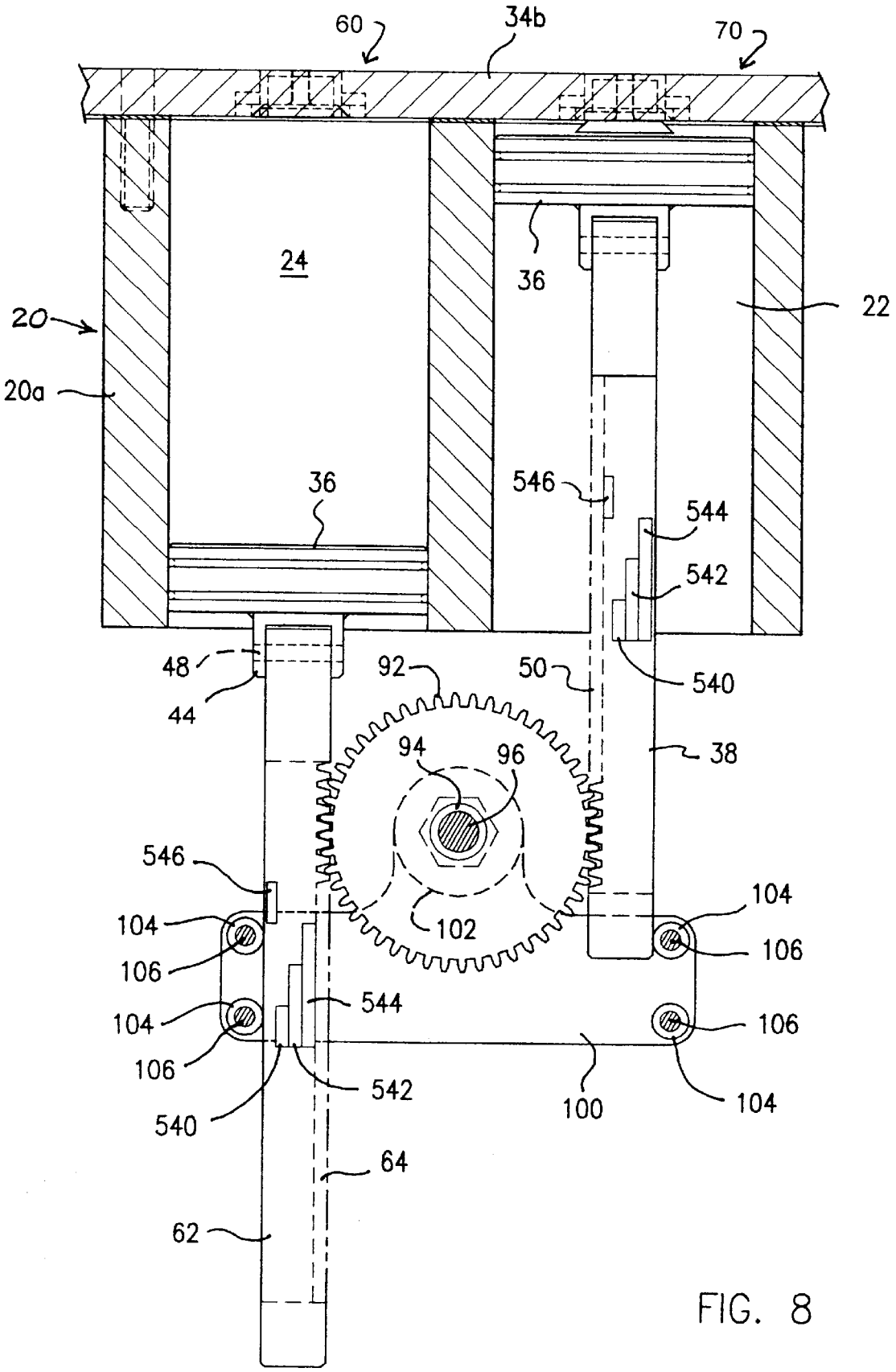
Figure 9:
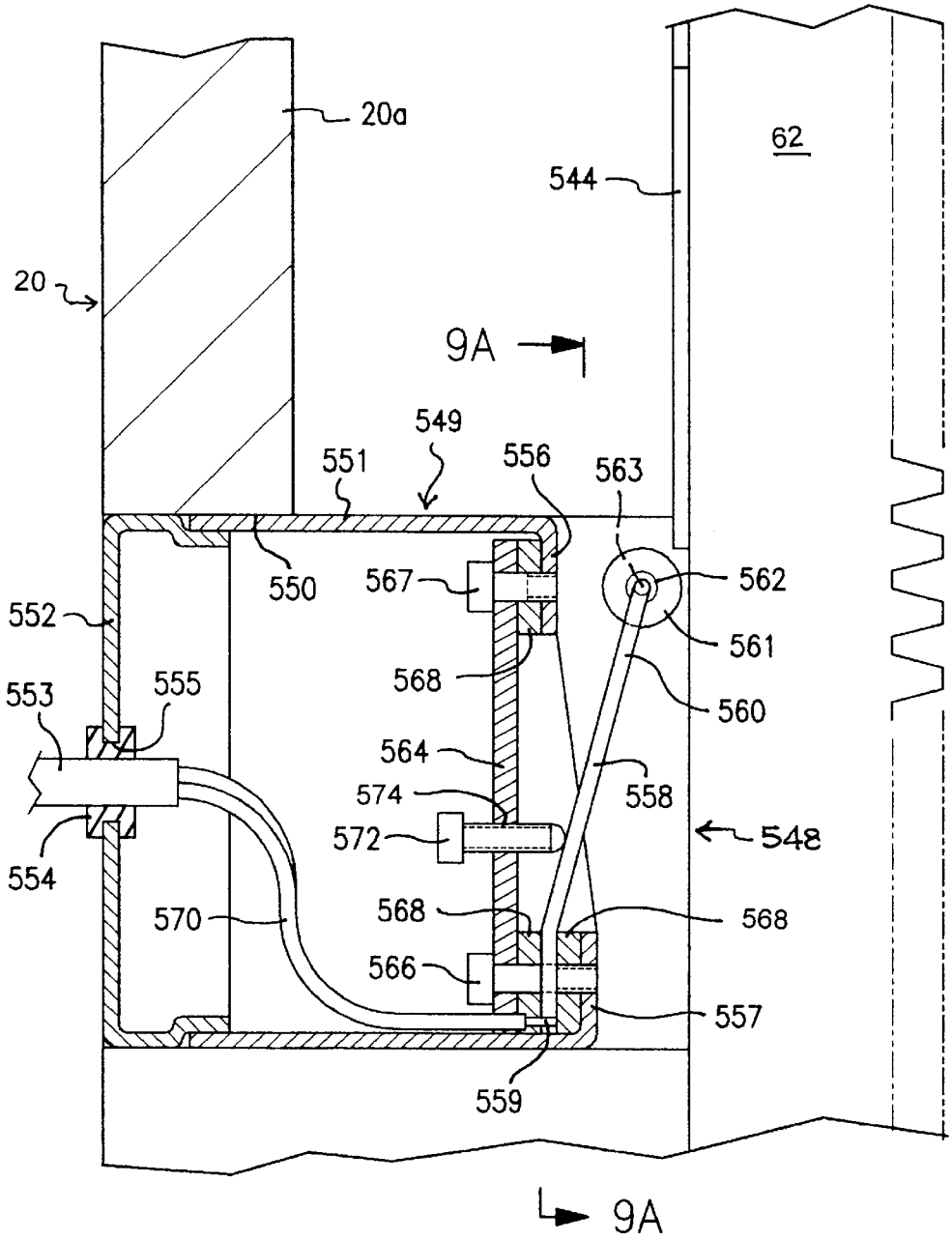
Figure 9A:
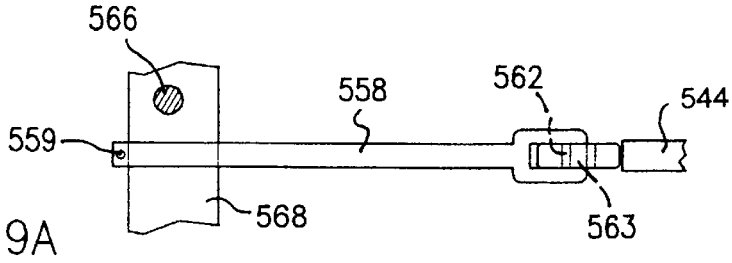

FIG. 4, a fragmentary view in transverse vertical section taken on the line 4—4 of FIG. 1 and showing solenoids for operating the intake and exhaust valves, the lower part of the view being broken out;

FIG. 5, a fragmentary view in bottom plan taken on the line 5—5 of FIG. 4;

FIG. 6, a fragmentary view partly in horizontal section taken on the line 6—6 of FIG. 4;

FIG. 7, a view corresponding to that of FIG. 4 but showing an alternate type of magnet in a valve operating solenoid;

FIG. 8, a fragmentary view in longitudinal vertical section taken on the line 8—8 of FIG. 2B and showing the piston rod timing gear racks, the timing gear, and the actuation plates of the pair of power units;

FIG. 9, a fragmentary view in vertical section taken on the line 9—9 of FIG. 2B drawn to a large scale, showing the switch box, a switch and an actuation plate;

FIG. 9A, a fragmentary view in longitudinal vertical section taken on the line 9A—9A of FIG. 9 showing a single switch actuation bar and wheel.

Figure 10:
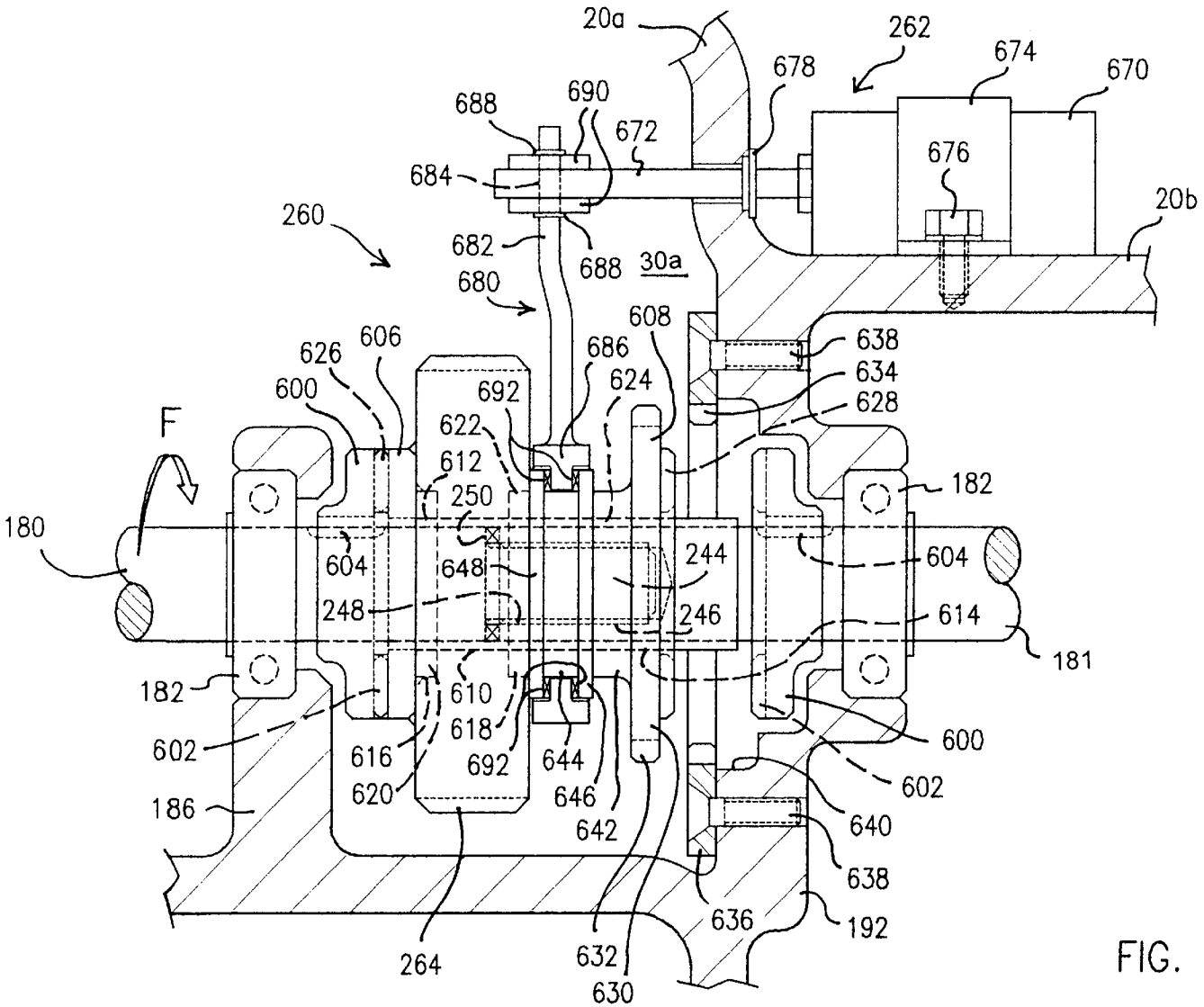
Figure 10A:
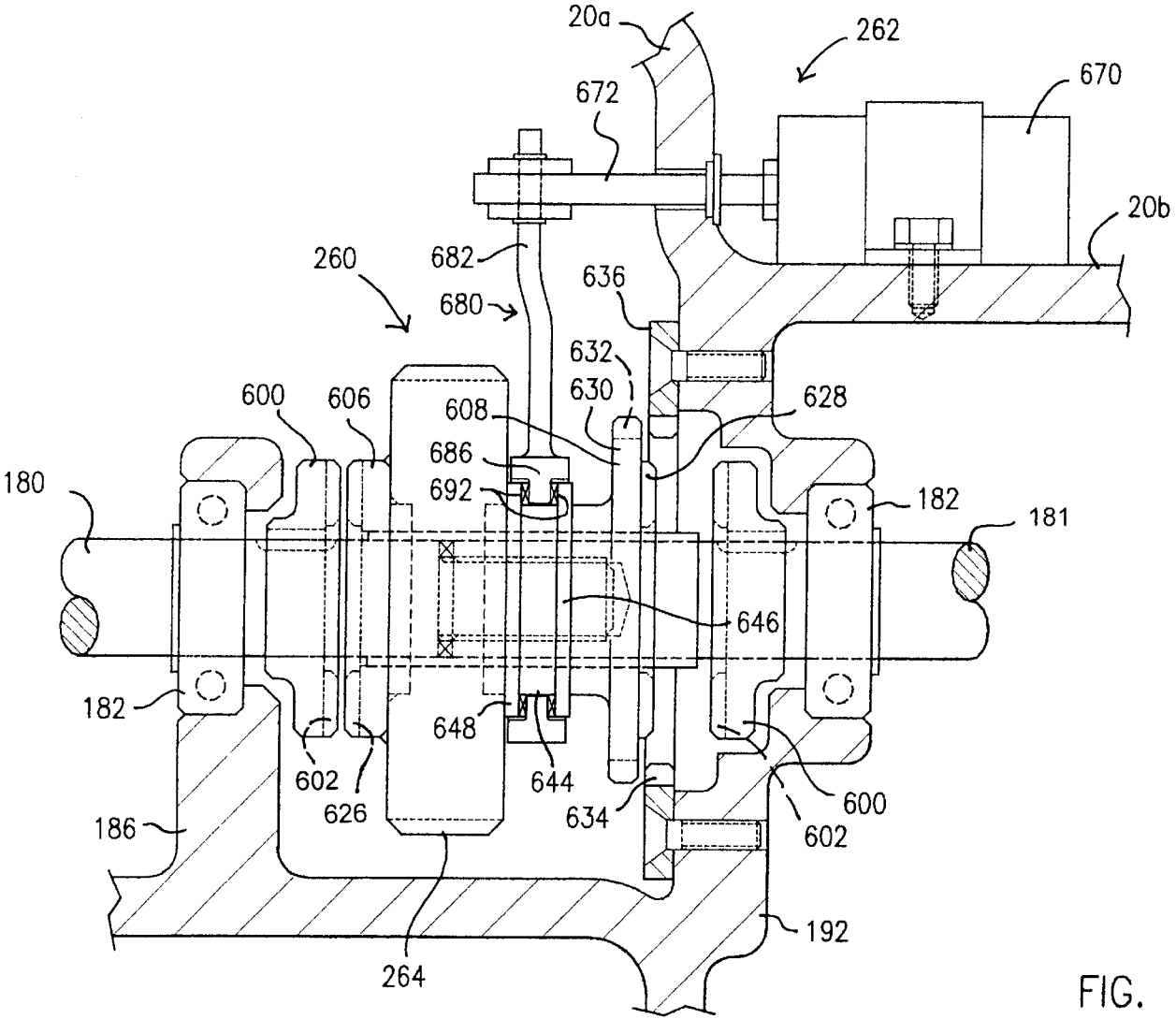
Figure 10B:
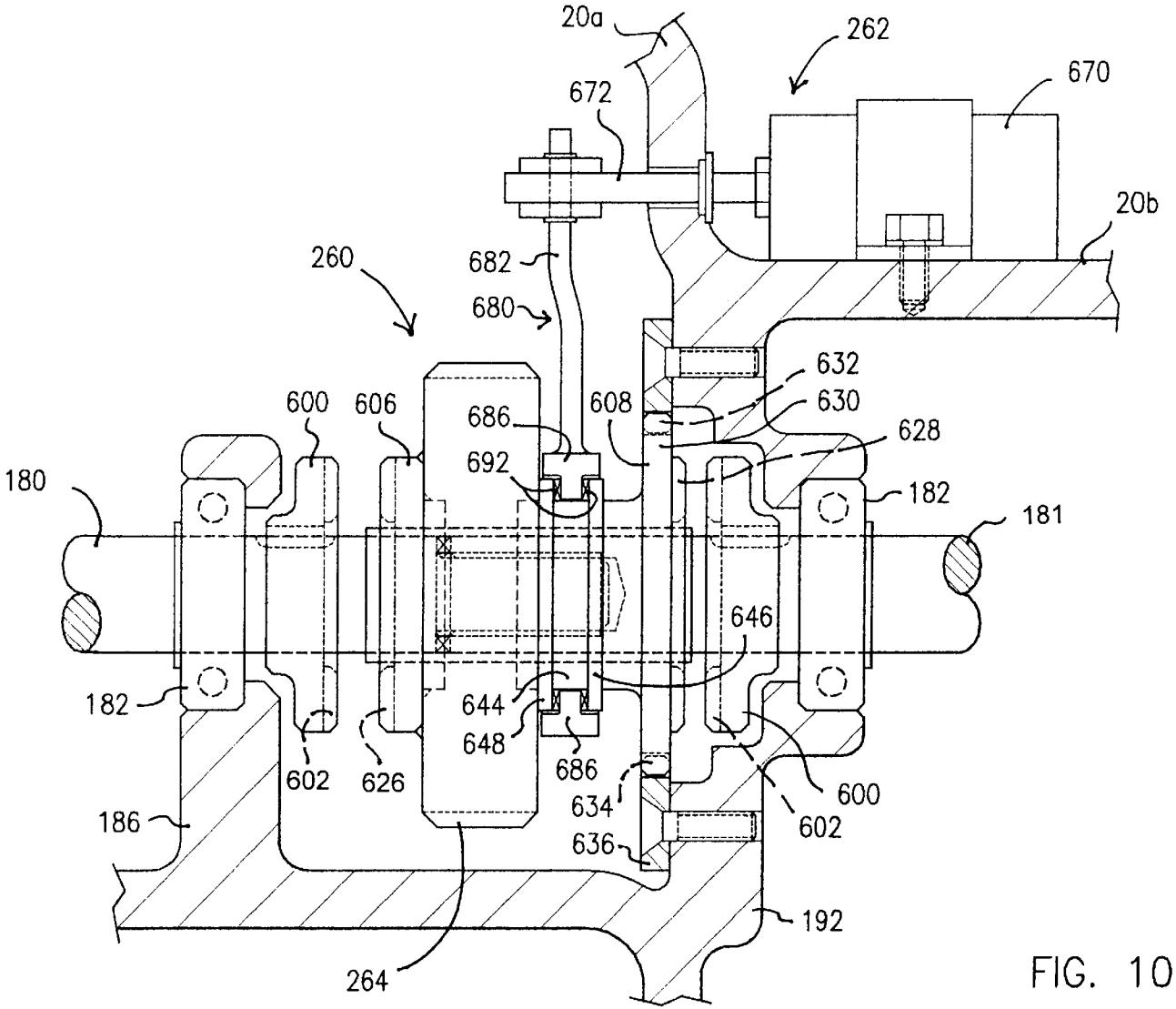
Figure 10C:
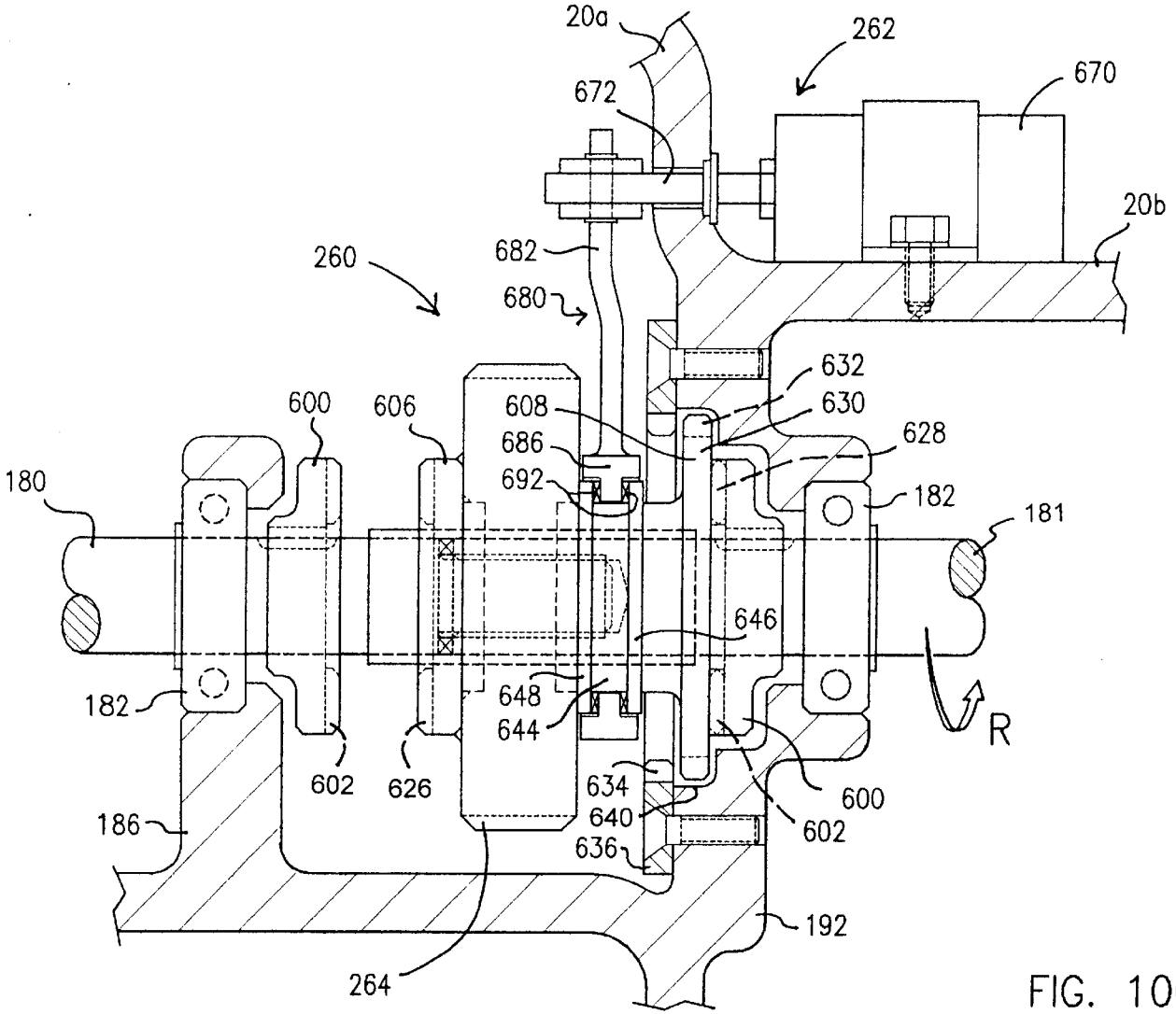
Figure 11:
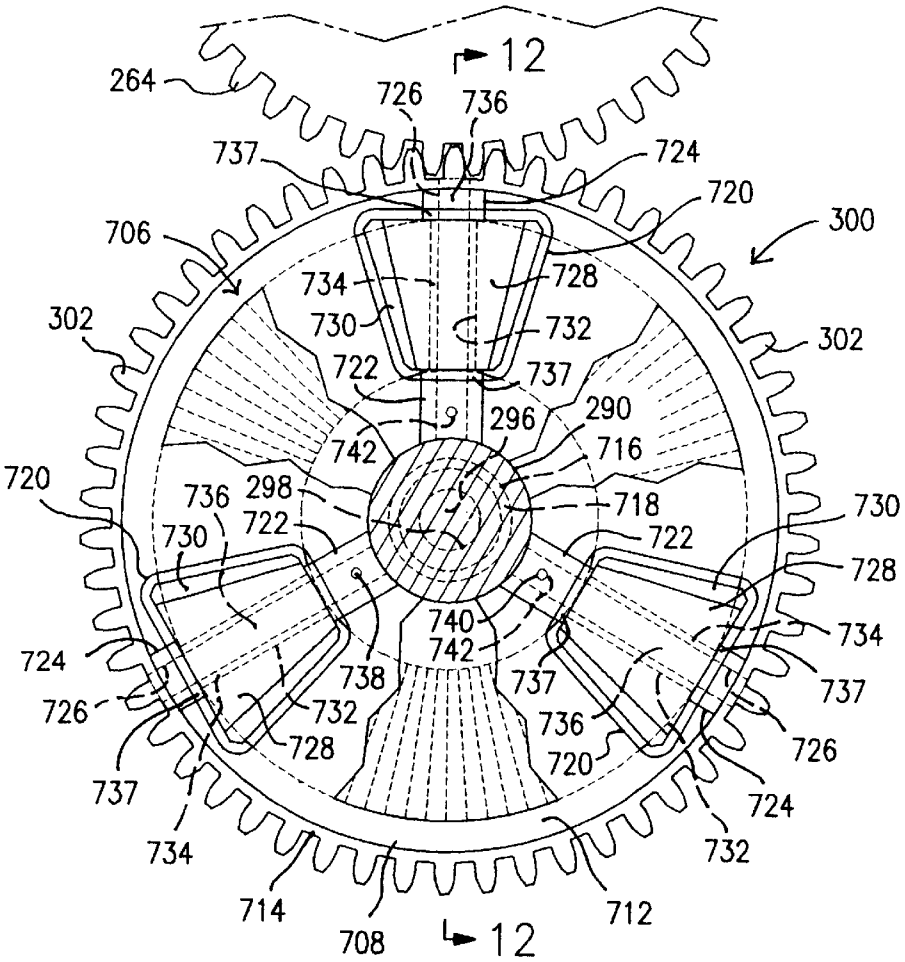
Figure 12:
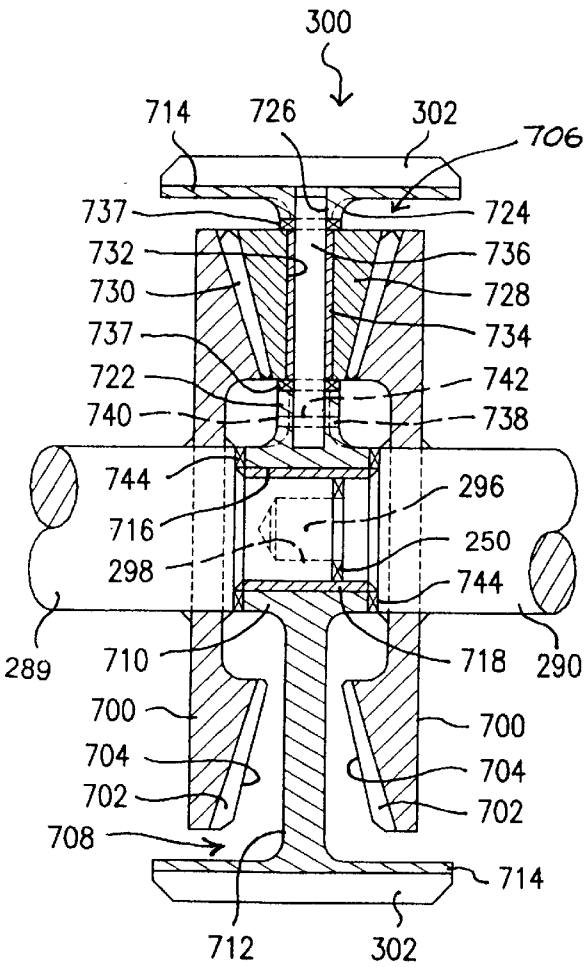

FIG. 10, a view in longitudinal horizontal section taken on the line 10—10 of FIG. 2 drawn to a larger scale and showing the clutch mechanism with the clutch in the forward drive position;

FIG. 10A, a corresponding view but having the clutch in the neutral position;

FIG. 10B, a corresponding view but having the clutch in the park position;

FIG. 10C, a corresponding view but having the clutch in the reverse drive position;

FIG. 11, a fragmentary view in lateral vertical section taken on the line 11—11 of FIG. 2 drawn to a larger scale, showing the differential mechanism;

FIG. 12, a fragmentary view in longitudinal vertical section taken on the line 12—12 of FIG. 11.

Figure 13:
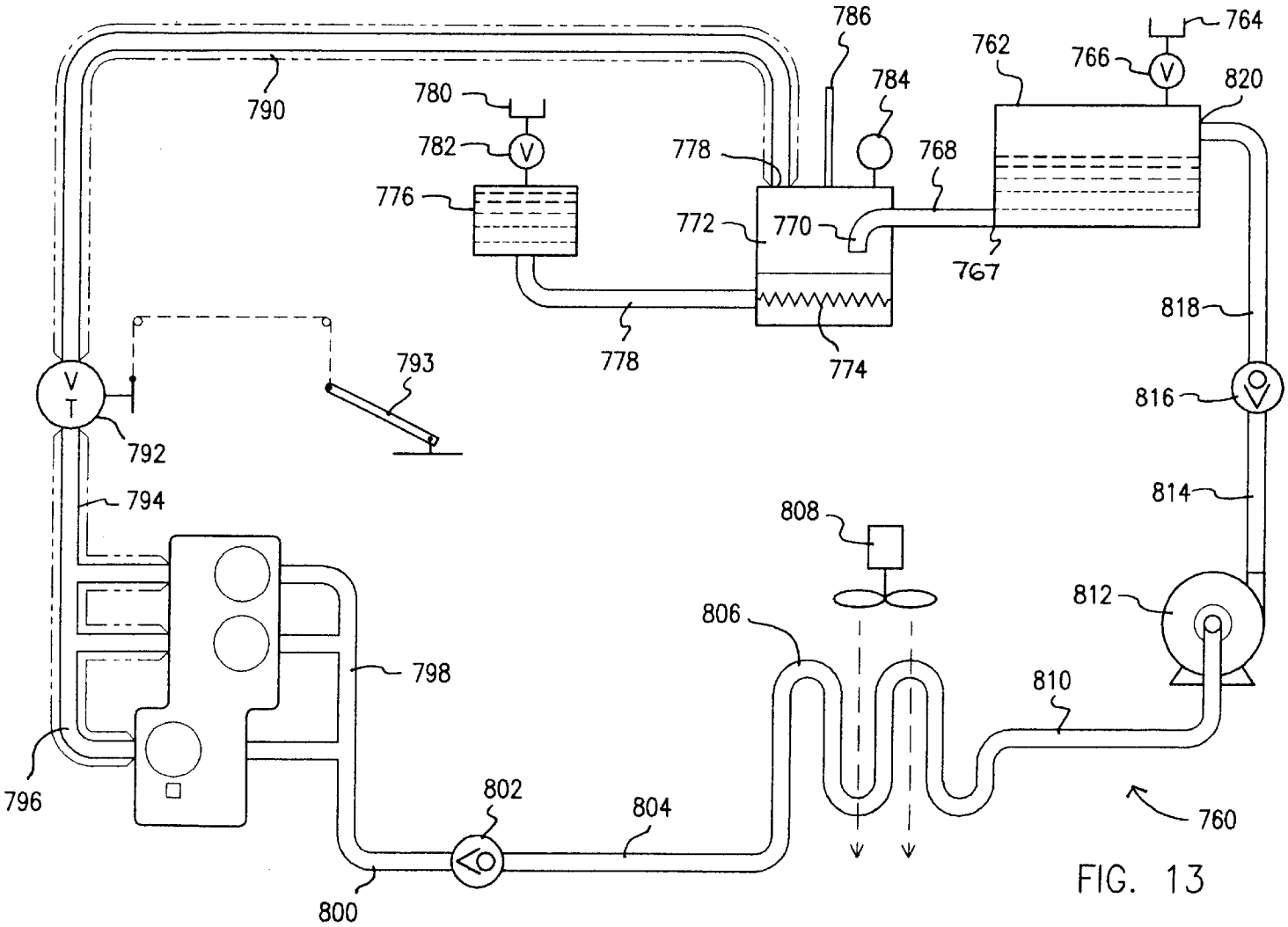

FIG. 13, a schematic diagram of the pressurized fluid system.

Figure 14:
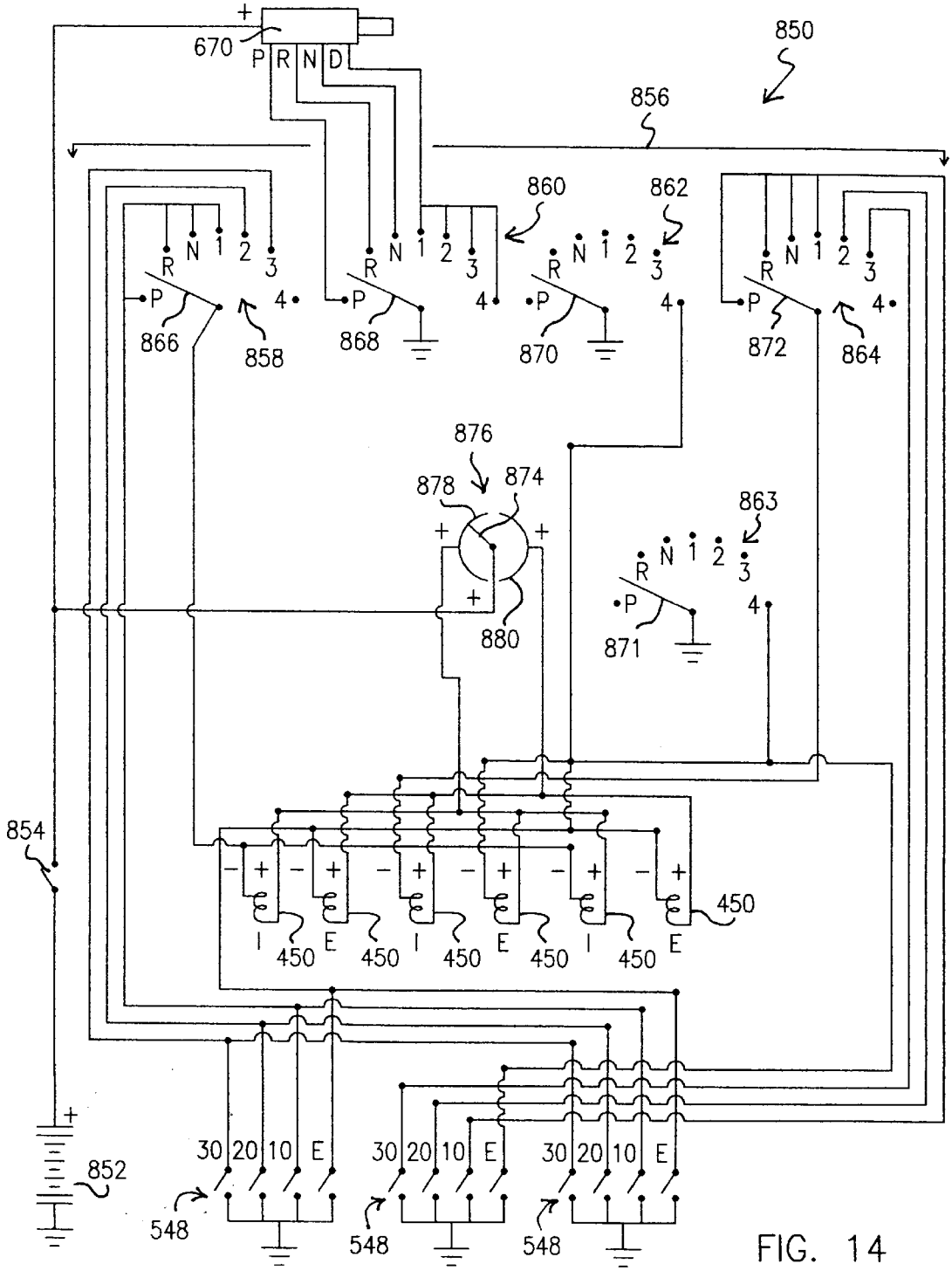

FIG. 14, a schematic diagram of the electrical system.

Figure 15:
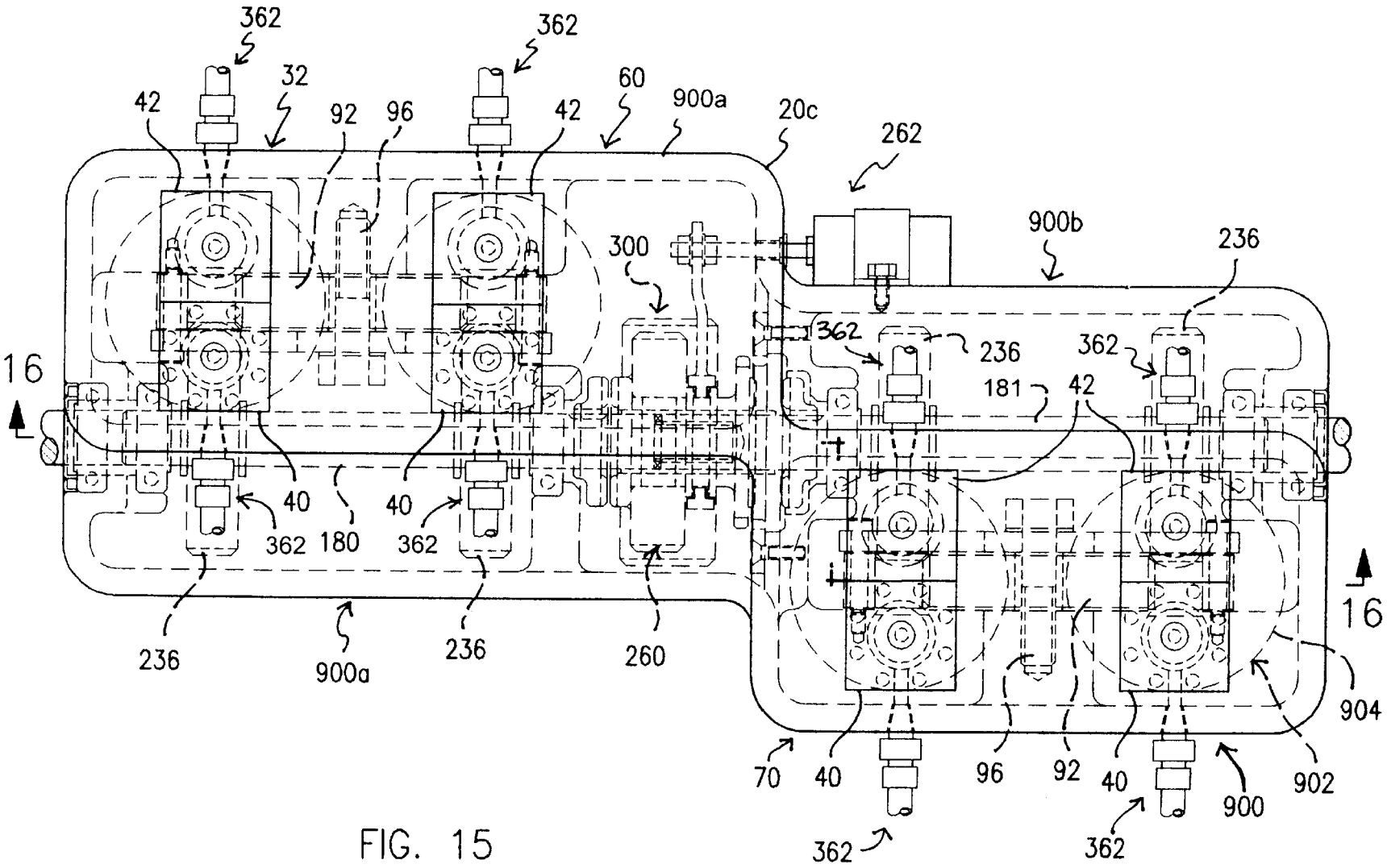

FIG. 15, a plan view, with internal structure and mechanism shown by broken lines, of a second embodiment of the invention as applied to automotive use, the engine utilizing a pair of reverse power units both of which have pistons.

Figure 16:
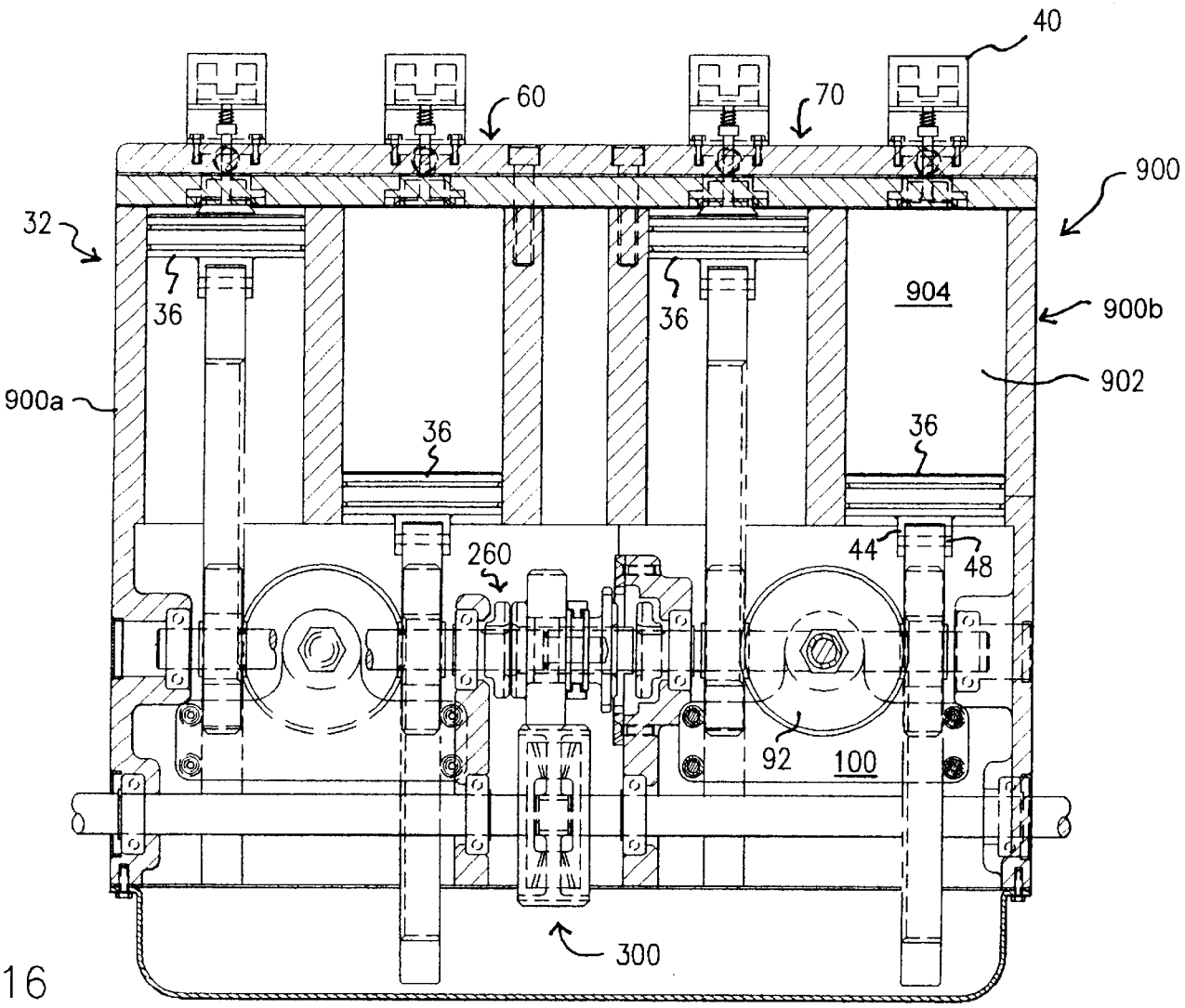

FIG. 16, a view in longitudinal vertical section taken on the line 16—16 of FIG. 15 and drawn to a reduced scale.

Figure 17:
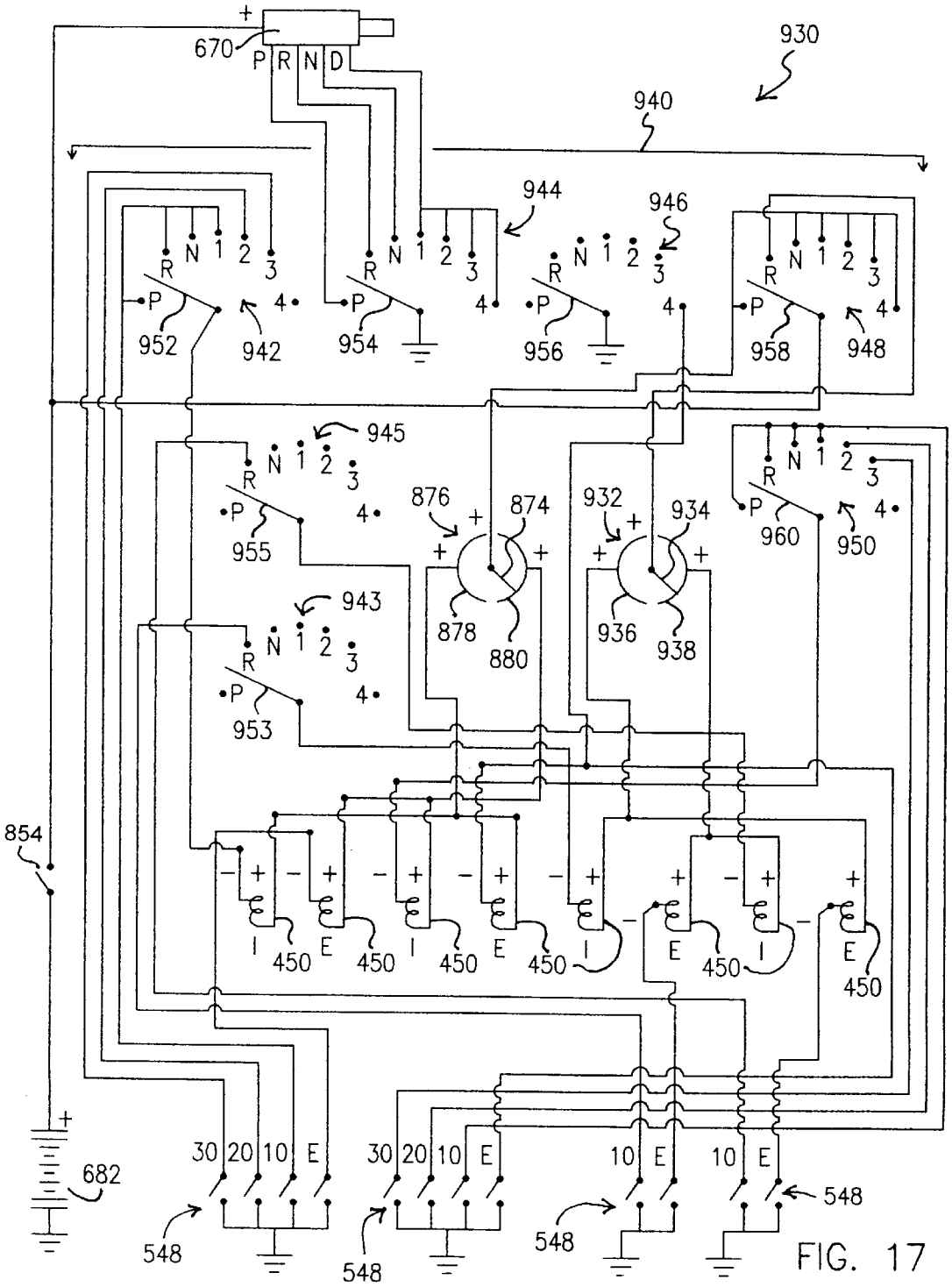

FIG. 17, a schematic diagram of the electrical system of the second embodiment of the invention.

DETAILED DESCRIPTION OF THE ILLUSTRATED EMBODIMENTS

A first embodiment of the invention applied to automotive use is shown as an assembled engine in FIGS. 1 and 2, which engine has forward and reverse drive capabilities, with neutral and park functions, as needed to power an automotive vehicle.

Referring to FIGS. 1 and 2, an engine block 20 is made with mutually offset sections 20*a* and 20*b* to accommodate a pair of piston cylinders 22 and 24 in section 20*a* and a cylinder 26 and rack rod cylinder or chamber 28 in section 20*b*. Cylinders 22 and 24 constitute the cylinders of first and second piston and cylinder power units 32 and 60, respectively, of a pair of such power units to power the automotive vehicle in a forward direction, while cylinder 26 and cylinder or chamber 28 constitute the rack rod cylinders of a third piston and cylinder power unit 70 and of a reversing unit 80, respectively, such as to power an automotive vehicle in a reverse direction. Engine block 20 is preferably cast to shape from a suitable electrically conductive metal such as aluminum or cast iron for a reason which will be explained subsequently. Engine block 20 has inner chambers 30*a* and 30*b* within the corresponding offset sections 20*a* and 20*b*, below the respective cylinders 22, 24, and 26, and 28.

The first piston and cylinder power unit 32 comprises cylinder 22 and piston 36 with piston rod 38, a cylinder head 34 having upper plate 34*a* and lower plate 34*b*, provides a top for engine block 28, while an intake valve and solenoid assembly 40, provides for intake pressure fluid and an exhaust valve and solenoid assembly 42 provide for exhaust. Piston 36 has a bracket 44 integral therewith or affixed thereto by means such as screws or rivets (not shown), brazing, or welding. Bracket 44 has a pair of downwardly dependent ears 46 to which piston rod 38 is pivotally attached by means such as a pin 48. This pivotal connection of piston 36 and bracket 44 to piston rod 38 allows for some misalignment between piston 36 and piston rod 38 so as to minimize side forces and the resulting wear therefrom to the wall of cylinder 22. Piston rod 38, as with all of the piston rods, preferably have a square cross-section, though a rectangular cross-section will likewise work, with one side thereof having a first, or timing gear rack 50, and another side thereof having a second, or driving gear rack 52. Piston 36 has a pair of annular grooves 54 in which are disposed a pair of piston rings 56, preferably of the self-lubricating type, which seal between piston 36 and the wall of cylinder 22. Cylinder head upper plate 34*a* and lower plate 34*b* are attached to cylinder block 20 by means such as bolts 57, and sealed by means such as gaskets 58 and 59, respectively, sandwiched therebetween. The flow of pressure fluid into cylinder 22 is controlled by intake valve and solenoid assembly 40, and the flow of exhaust pressure fluid is controlled by exhaust valve and solenoid assembly 42, which are attached to cylinder head 34 by means such as bolts best shown in FIG. 4.

The second piston and cylinder power unit 60, FIG. 2, comprises cylinder 24 and piston 36 with piston rod 62, with cylinder head 34, intake valve and solenoid assembly 40, exhaust valve and solenoid assembly 42, and the other associated parts performing similar functions as listed for first power unit 32 above. The components of second power unit 60 fit together and function the same as in first power unit 32, with the only difference being the use of a different piston rod 62 which replaces piston rod 38. Piston rod 62 preferably has a square cross-section with one side thereof having a first, or timing gear rack 64, and another side thereof having a second, or driving gear rack 66. A longitudinal groove 68 extends for part of the length of piston rod 62 on the side thereof opposite timing gear rack 64. The function of groove 68 will be explained subsequently.

The third piston and cylinder power unit 70, FIG. 2, comprises cylinder and piston 36 with piston rod 72, with cylinder head 34, intake valve and solenoid assembly 40, exhaust valve and solenoid assembly 42, and the other associated parts performing similar functions as listed for power units 32 and 60 above. The components of third power unit 70 fit together and function the same as in first power unit 32 and second power unit 60, with the only difference being the use of a different piston rod 72. Piston rod 72 preferably has a square cross-section with one side thereof having a first, or timing gear rack 74, and another side thereof having a second, or driving gear rack 76. A longitudinal groove 78 extends for part of the length of piston rod 72 on the side thereof opposite timing gear rack 74. The function of groove 78 will be explained subsequently.

A reversing unit 80, FIG. 2, comprises rack rod cylinder 28, cylinder or chamber head 34, and an elongate rack rod 82, which preferably has a square cross-section with one side thereof having a first, or timing gear rack 84, and another side thereof having a second, or driving gear rack 86. Cylinder or chamber 28 is preferably square in cross-section, esuch as made by broaching, and of such size as to closely fit with rack rod 82. An air channel 88 joins with cylinder or chamber 28 at air passage 90 so as to allow air displaced by rack rod 82 in cylinder or chamber 28 to flow into inner chamber 30*b* during the upstroke of rack rod 82, and to flow in the reverse direction during the downstroke of rack rod 82. This minimizes engine drag which would occur if the air in cylinder or chamber 28 was not free to flow. Alternatively, a round cylinder (not shown) of a diameter within which rack rod 82 can closely fit and be guided by the corners thereof contacting the wall of the cylinder can be utilized. In this case, rack rod 82 can be made having slightly rounded corners which match the round contour of the chamber, as by making rack rod 82 from round bar stock and then machining flat faces thereon, so as to increase the bearing surface against the wall of the cylinder. In this alternate version, air channel 88 and air passage 90 can be eliminated, since the rack rod (not shown) is substantially square in cross-section and the cylinder is round in cross-section such as to allow the air in the cylinder to flow therebetween during engine operation. The function of reversing unit 80 will be explained subsequently.

Referring to FIGS. 2 and 2B, the first power unit 32 and second power unit 60 are maintained in a timed, opposing operational orientation by means of a first timing gear 92, which is adapted to mesh with timing gear rack 50 of first power unit 32 and timing gear rack 64 of second power unit 60. First timing gear 92 has an aperture 93 wherein a bushing 94 is press-fit. First timing gear 92 is rotationally mounted on a shoulder bolt 96, which extends through bushing 94, between a first inverted T-shaped boss 98 of cylinder block offset section 20*a* and a T-shaped plate 100. A pair of flat washers 102 are disposed one at each side of timing gear 92 to facilitate rotational movement thereof. Four rollers 104 are each rotationally disposed on shoulder bolts 106, between plate 100 and boss 98, with two thereof rotationally disposed against each of piston rods 38 and 62, respectively, opposite timing gear 92 to maintain timing gear racks 50 and 64 in mesh with timing gear 92. Shoulder bolts 106 maintain the spacing between plate 100 and boss 98 to allow free rotation of rollers 104. Timing gear 92 functions such that when piston 36 and piston rod 38 of power unit 32 are traveling downward during a power stroke thereof, piston 36 and piston rod 62 of power unit 60 are pushed upwardly by way of timing gear 92 acting on timing gear racks 50 and 64, respectively, to effect an exhaust stroke in power unit 60, and vice-versa.

Third power unit 70 and reversing unit 80 are maintained in a timed, opposing operational orientation in a similar manner to that of power units 32 and 60. A smaller diameter, second timing gear 108, which is adapted to mesh with timing gear rack 74 of third power unit 70 and timing gear rack 84 of reversing unit 80. Second timing gear 108 has an aperture 109 wherein bushing 94 is press-fit. Second timing gear 108 is rotationally mounted on shoulder bolt 96, which extends through bushing 94, between a second inverted T-shaped boss 110 of cylinder block offset section 20*b* and a T-shaped plate 112. A pair of flat washers 102 are disposed one at each side of timing gear 108 to facilitate rotational movement thereof. Four rollers 104 are each rotationally disposed on shoulder bolts 106, between plate 112 and boss 110, with two thereof rotationally disposed against each of piston rods 72 and 82, respectively, opposite timing gear 108 to maintain timing gear racks 74 and 84 in mesh with timing gear 108. Shoulder bolts 106 maintain the spacing between plate 112 and boss 110 to allow free rotation of rollers 104. Timing gear 108 functions such that when piston 36 and piston rod 72 of power unit 70 are traveling downward during a power stroke thereof, piston rod 82 of reversing unit 80 acting on timing gear racks 74 and 84, respectively, is pushed upwardly by way of timing gear 108. However, since reversing unit 80 does not have a piston 36 to move piston rod 82 in a downward direction so as to move piston 36 and piston rod 72 of power unit 70 upwardly by way of timing gear 108, a synchronizing or coupling system 150 is utilized to connect either power units 32 and 70 together, or preferably power units 60 and 70, so as to effect an exhaust stroke in power unit 70.

Referring to FIGS. 2A, 3, and 3A, synchronizing or coupling system 150 is shown interconnecting power units 60 and 70. FIG. 3A shows piston 36 and piston rod 62 of second power unit 60 in the upper, or full exhaust stroke position and piston 36 and piston rod 72 of third power unit 70 in the lower or full power stroke position. As piston 36 and piston rod 62 of second power unit 60 descend in a power stroke due to pressurized fluid being introduced into cylinder 24, a flexible cable 152, attached to the lower end of each of piston rods 62 and 72 through a pair of pulley assemblies 154, pulls upwardly on piston rod 72 so as to move piston rod 72 and piston 36 upwardly to the position shown in FIG. 3 so as to effect an exhaust stroke in power unit 70.

Flexible cable 152, preferably made of nylon or steel braid so as to be flexible yet strong, has at each end thereof a loop 158 which can be formed from the ends of cable 152 and held such as by a crimped connector 160 and brazed if necessary. Alternatively, other suitable means can be used in place of loops 158 such as a separate loop-shaped connector or lug (not shown) which is brazed or welded to the ends of cable 152. Loops 158 are disposed in pockets 162 and 163 of longitudinal grooves 68 and 78, respectively, and are retained in place such as by pins 164. Cable 152 rests in longitudinal grooves 68 and 78 such that it can pass under rollers 104 during both the power and exhaust strokes of the respective power units 60 and 70.

In FIGS. 3B and 3C are shown pulley assemblies 154 each of which have a U-shaped bracket 166 to which a pair of rollers 168 are rotatably mounted. Each U-shaped bracket 166 has a base portion 170 and two arms 172 and 173. One of rollers 168 is rotatably mounted between arms 172 and 173 such as by a pin 174, and another roller 168 is rotatably mounted to base portion 170. Pins 174 may be headed or not and maintained in position by means such as crimping, heading, or snap rings, (not shown). An aperture 175 through arm 173 allows passage therethrough of flexible cable 152.

Referring to FIGS. 2A and 3C, pulley assemblies 154 are secured one each to cylinder block offset sections 20*a* and 20*b* by means such as bolts 176. Pulley assemblies 154 are oriented so as to have minimal side force on the rollers 168 and such that flexible cable 152 maintains a position closely adjacent to piston rods 62 and 72 during the full downward power stroke and the upward exhaust stroke thereof.

As best seen in FIGS. 2B and 2D, first and second drive shafts 180 and 181 extend through inner chambers 30*a* and 30*b*, respectively, for most of the longitudinal length of engine block 20, with first drive shaft 180 disposed in section 30*a*, and second drive shaft 181 disposed in section 30*b*. First drive shaft 180 is supported for rotation, at one end by a bearing 182 supported by a boss 184 of offset section 20*a*, and at the opposite end by bearing 182 supported by a web 186 of offset section 20*a*. Second drive shaft 181 is supported for rotation, at one end by bearing 182 supported by a boss 188 of offset section 20*b*, and at the opposite end by bearing 182 supported by a boss 190 of a web 192 of offset section 20*b*. Bearings 182 are longitudinally secured to the respective first and second drive shafts 180 and 181 by suitable means such as external snap rings (not shown). Bearings 182 are secured to their respective bosses 184, 188, 190, and web 186 by suitable means such as internal snap rings (not shown).

As best seen in FIG. 2, bosses 184 and 188 preferably have apertures 194 and 196, respectively, through which first and second drive shafts 180 and 181 can be passed during engine assembly. In such a case, suitable oil retention means should be employed such as caps 198 to cover and seal apertures 194 and 196 to prevent oil from escaping therethrough.

Again referring to FIGS. 2B and 2D, a first pair of unidirectional roller clutches 230, each having an outer driven portion 232 and an inner driving portion 234, are rotationally affixed to first drive shaft 180 by means such as by keying, splining, or press fitting (not shown) and longitudinally affixed thereto by means such as external retaining rings (not shown). Roller clutches 230 transmit torque from outer driven portion 232 to inner driving portion 234 in one rotational direction only, and spin freely or "freewheel" in the opposite direction. Roller clutch outer driven portions 232 each have a coaxial pinion gear 236 which is integral therewith or disposed on and affixed thereto by means such as welding, brazing, keying, splining, press fitting, or external retaining rings (not shown). Each pinion gear 236 is adapted to mesh with one of driving gear racks 52 and 66 of piston rods 38 and 62, respectively. Power units 32 and 60 thus are engaged with first drive shaft 180 so as to rotate the same in what will be called the forward drive rotation.

Referring to FIGS. 2B, 2D, and 3A, a second pair of unidirectional roller clutches 238, each having an outer driven portion 240 and an inner driving portion 242 are rotationally affixed to second drive shaft 181 by means such as by keying, splining, or press fitting (not shown), and longitudinally affixed thereto by means such as external retaining rings (not shown). Roller clutches 238 transmit torque from outer driven portion 240 to inner driving portion 242 only in the rotational direction opposite that of the first pair of roller clutches 230, and spin freely or "freewheel" in the opposite direction. Roller clutch outer driven portions 240 each have a coaxial pinion gear 236 which is integral therewith or disposed on and affixed thereto, by means such as welding, brazing, keying, splining, press fitting, or external retaining rings (not shown). Each pinion gear 236 is adapted to mesh with one of driving gear racks 76 and 86 of piston rods 72 and 82, respectively. Power unit 70 and reversing unit 80 thus are engaged with second drive shaft 181 so as to rotate the same in what will be called the reverse drive rotation. While reversing unit 80 does not develop any power itself, power is transmitted to its respective roller clutch 238 by means of power unit 60, during its power stroke pulling on flexible cable 152 so as to move piston rod 72 upwards in an exhaust stroke causing rotation of timing gear 108 by engagement with timing gear rack 74 of piston rod 72. The rotation of timing gear 108 moves rack rod 82 downward by engagement with timing gear rack 84, which also moves driving gear rack 86 of rack rod 82 downwardly which engages pinion gear 236 and causes roller clutch 238 to rotate. This effectively transfers power from power unit 60 to reversing unit 80 to assist in powering second drive shaft 181 in the reverse drive rotation.

As can be seen best in FIG. 10, the adjacent ends of first drive shaft 180 and second drive shaft 181 fit together by means of first drive shaft 180 having a pilot portion 244 which is rotationally disposed within a pilot hole 246 in second drive shaft 181. A bushing 248 is press-fit into pilot hole 246 so as to provide a bearing for pilot portion 244 to rotate. A thrust bearing 250 is axially disposed about pilot portion 244 and abuts second drive shaft 181 to absorb any longitudinal forces between first and second drive shafts 180 and 181, such as those forces which would be created if the pinion gears 236 and driving gear racks 52, 66, 76, and 86 are helical gears, and gear racks which are capable of transmitting higher power loads.

A clutch assembly 260 is closely fit coaxially about adjacent ends of first drive shaft 180 and second drive shaft 181, and operatively slides longitudinally thereon, at the urging of an actuator assembly 262, so as to allow selective coupling of a drive gear 264 to first drive shaft 180 or second drive shaft 181. This allows power from power units 32 and 60 to power drive gear 264 in the forward drive rotation, or power units 60 (through reversing unit 80) and 70, to power drive gear 264 in the reverse drive rotation. The details of clutch assembly 260 and actuator assembly 262 will be explained subsequently.

It should be noted that first and second drive shafts 180 and 181 can be made as a single drive shaft (not shown) of the same length as the two combined. In that case the drive shaft is fixed so as not to rotate and a pair of elongate bushings (not shown) closely fit around the drive shaft, one of which bushings links the roller clutch inner driving portions 234 of first and second power units 32 and 60 and the other of which bushing links the roller clutch inner driving portions 242 of third power unit 70 and reversing unit 80. Each bushing is adapted to selectively drive clutch 260 in a similar manner as first and second drive shafts 180 and 181.

Referring to FIGS. 2C and 2D, a first jackshaft 289 extends through inner chamber 30*a*, below first drive shaft 180, and a second jackshaft 290 extends through inner chamber 30*b*, below second drive shaft 181. First jackshaft 289 is supported for rotation at one end by bearing 182 disposed in an aperture 291 of a boss 292 of offset section 20*a* and at the opposite end by bearing 182 supported by web 186 of offset section 20*a*. Second jackshaft 290 is supported for rotation, at one end by bearing 182 disposed in an aperture 293 of a boss 294 of offset section 20*b* and at the opposite end by bearing 182 supported by web 192 of offset section 20*b*. Bearings 182 are longitudinally secured to the respective first and second jack shafts 289 and 290 by suitable means such as external snap rings (not shown). Bearings 182 are held secured to their respective bosses 292, 294, and webs 186, 192, by suitable means such as internal snap rings (not shown). Oil seals 295 are pressfit into apertures 291 and 293 of bosses 292 and 294, respectively, around first and second jackshafts 289 and 290 to prevent oil from escaping therefrom.

As can be seen best in FIG. 12, the adjacent ends of first and second jackshafts 289 and 290 fit together by means of first jackshaft 289 having a pilot portion 296 which is rotationally disposed within a pilot hole 298 in second jackshaft 290. A thrust bearing 250 is axially disposed about pilot portion 296 and abuts second jackshaft 290 to absorb any longitudinal forces between first and second jackshafts 289 and 290.

Referring to FIG. 11, a differential assembly 300 has a peripheral gear 302, and is attached to adjacent ends of first and second jackshafts 289 and 290, with drive gear 264 in mesh with peripheral gear 302. The width of peripheral gear 302 is such that drive gear 264 is in full mesh with peripheral gear 302 in any of the functional positions of drive gear 264 and clutch assembly 260. An automotive vehicle wheel (not shown) is typically attached to the distal ends of first and second jackshafts 289 and 290. The differential 300 transfers power from gear 264 to first jackshaft 289 and second jackshaft 290, while allowing each to rotate at a different speed, such as necessary during cornering on an automotive type vehicle wherein the outside wheel must rotate faster than the inside wheel in a turn. The details of differential assembly 300 will be explained subsequently.

Referring to FIGS. 2 and 2D, an oil drip pan 310, which has a circumferential outwardly extending lip 312, is attached to the underside of engine block 20, along with a sealing gasket 314, such as by bolts 316. Oil drip pan 310 is of sufficient depth so as to clear the ends of piston rods 38, 62, 72, and 82 in the lowest position of the exhaust stroke. An oil or grease type lubricant may be applied to all moving parts of the engine at initial assembly and at fixed intervals, with oil drip pan 310 catching such lubricant which comes off the moving parts. Alternately, oil drip pan 310 can be partially filled with oil or other free-flowing type lubricant and splash-type lubricating be utilized with the lower ends of piston rods 38, 62, 72, and rack rod 82 impacting the oil during engine operation so as to splash the oil or other lubricant onto the working components of the engine. Flat sheet metal splash plates (not shown) may be affixed to the bottoms of some or all of piston rods 38, 62, 72, and rack 82 so as to increase the effective area impacting the surface of the oil so as to increase the splash effect thereof. A one-way oil breather (not shown) may be mounted through engine block 20 to allow pressure fluid, which blows-by pistons 36 and piston rings 56, to escape from inner chambers 20*a* and 20*b* while preventing ambient air and contamination from entering the same. A breather containing a filter media may be used which traps contaminants which would otherwise be blown onto the outside of the engine. Likewise, an oil level dip stick and holding tube (not shown) may be used which extend through engine block 20 into oil drip pan 310 to allow convenient monitoring of the engine oil level in oil drip pan 310.

Referring to FIGS. 2D, 4, 5, and 6, cylinder head lower plate 34*b* has a pair of apertures or ports 330 and 332 extending therethrough, one pair for each of cylinders 22, 24, and 26. The first port of each pair is an intake port 330 and the second port is an exhaust port 332. Each intake port 330 has a matching coaxial intake valve stem aperture 334, a portion thereof being the same diameter as intake port 330 and which extends through upper plate 34*a* and which has a smaller diameter portion 336. An axial groove 338 is disposed in smaller diameter portion 336. Likewise, each exhaust port 332 has a coaxial exhaust valve stem aperture 340, a portion thereof being of the same diameter as exhaust port 332 and which extends through upper plate 34*a* and which has a smaller diameter portion 342. An axial groove 344 is disposed in smaller diameter portion 342. Cylinder head lower plate 34*b* has a plate portion 346 perpendicularly disposed to intake port 330, with an intake valve seat 348 defined by passageways 350 (FIG. 5), which along with intake port 330 and intake valve stem aperture 334, define an interior intake chamber 352. Cylinder head lower plate 34*b* also has an annular tapered seat 354 at the lower end of exhaust port 332. Exhaust port 332 and exhaust valve stem aperture 340 define an interior exhaust chamber 356.

A pressure fluid inlet aperture 358, having a threaded outer portion 360, extends into upper plate 34*a* and connects with intake interior intake chamber 352. A pressure fluid hose assembly 362 terminating in a nipple 364 connects to threaded outer portion 360 for admitting pressure fluid into the respective cylinder 22, 24, or 26. A pressure fluid outlet aperture 366, having a threaded outer portion 368, extends into upper plate 34*a* and connects with interior exhaust chamber 356. Another pressure fluid hose assembly 362 terminating in nipple 364 connects to threaded outer portion 368 for channeling exhausted pressure fluid away from the respective cylinder 22, 24, or 26.

Intake valve and solenoid assembly 40, FIG. 4 comprises an intake valve 380 and an intake valve solenoid assembly 381. Intake valve 380 has an inverted cup portion 382 which is slidably disposed in intake port 330 and intake valve stem aperture 334, with an elongate stem 384 extending through smaller diameter portion 336. An O-ring 386 is disposed in axial groove 338 of smaller diameter portion 336, circumferentially about stem 384, so as to restrict pressure fluid in interior intake chamber 352 from escaping therefrom around stem 384. Inverted cup portion 382 includes a bottom 388 and an open end 390. Open end 390 of intake valve 380 rests on seat 348 of plate portion 346, with cup portion 382 and plate portion 346 defining an intake valve chamber 392. Cup portion bottom 388 has a plurality of pressure equalizing apertures 394 therethrough (FIG. 6).

Exhaust valve and solenoid assembly 42, FIG. 4, comprises an exhaust valve 420 and an exhaust valve solenoid assembly 421. Exhaust valve 420 has a lower disc portion 422 which includes an outer tapered rim 426, and an elongate stem 428 which coaxially depends from lower disc portion 422. Stem 428 extends through intake port 332 and exhaust interior chamber 356 and is slidably disposed in and extends through smaller diameter portion 342. O-ring 386 is disposed in axial groove 344 of smaller diameter portion 342, circumferentially about stem 428, so as to restrict pressure fluid in interior exhaust chamber 356 from escaping therefrom around stem 428. Outer tapered rim 426 mates with seat 354 when exhaust valve 420 is in the closed position so as to prevent pressure fluid from escaping from the respective cylinder.

Intake valve solenoid assembly 381, FIG. 4, comprises an electric solenoid 450, a bracket 452, which is shared with exhaust valve solenoid assembly 421, a compression spring 454, a coupling 456, and of bolts 458. Solenoid 450 is mounted to bracket 452 by means such an adhesive, bolts, or rivets (not shown). Bracket 452 is mounted to cylinder head upper plate 34*a* by means such as bolts 458. Intake valve stem 384 is connected to a stem 460 of solenoid 450 by means such as coupling 456, with compression spring 454 positioned between bracket 452 and coupling 456 so as to bias intake valve 380 against seat 348 of plate portion 346. When intake valve 380 is in the closed position, as shown, and a pressurized fluid, preferably dry steam at about 600 PSI gauge as from a standard flash or other type of boiler, is introduced through hose assembly 362, through interior intake chamber 352, through pressure equalizing apertures 394, and into intake valve chamber 392, the pressure in chambers 352 and 392 is equalized. Thus, even though the steam pressure is relatively high, the amount of force which compression spring 454 must apply between bracket 452 and coupling 456 to retain intake valve 380 in a sealing relation with seat 348 is minimized. Therefore, the amount of force which solenoid 450 must exert to unseat intake valve 380 from seat 348 is greatly reduced in relation to other types of intake valve designs, allowing the use of a solenoid of a smaller size than with other intake valve designs.

Exhaust valve solenoid assembly 421 comprises the same components as intake valve solenoid assembly 381, but with compression spring 454 positioned between cylinder head top plate 34*a* and coupling 456 so as to bias exhaust valve 420 against tapered seat 354 of cylinder head lower plate 34*b*.

Solenoid 450 comprises a permanent magnet 480 having an outer cup 482, and a center core 484 of slightly shorter length than outer cup 482. The closed end 486 of magnet 480 and the adjoining end 488 of core 484 are a magnetic north pole, while the open end 490 of magnet 480 and the free end 492 of core 484 are a magnetic south pole. A circular cover plate 494, preferably made of a non-magnetic material and having a central aperture 496, is affixed to open end 490 by means such as glue or screws (not shown). A disc 498, preferably made of metal and having coaxial dependant stem 460 is slidably disposed within outer cup 482 adjacent open end 490, with stem 460 extending through aperture 496 of cover plate 494, through an aperture 500 of bracket 452, and attached to intake valve stem 384 or exhaust gauge stem 428 using coupling 456. Disc 498 is of such a diameter as to leave a circumferential gap 502 between disc 498 and outer cup 482 to allow unimpeded sliding of disc 498. A squared-off, doughnut shaped coil 504, made from circularly wound fine copper wire and covered with an insulating material (not shown), has an abrasion resistant insulating core 506 affixed to the inner circumference thereof such as by adhesive bonding. Coil 504 is disposed around core 506 and is affixed to disc 498 such as by adhesive bonding.

When solenoid 450 is used in intake valve and solenoid assembly 40, compression spring 454, acting against bracket 452 and coupling 456, biases disc 498 with stem 460 downward such that when intake valve 380 fully seats against cylinder head plate portion 346 so as to provide a good seal therewith, and disc 498 does not contact cover plate 494. Solenoid 450 is operated by applying a DC voltage through coil 504 such that current flows in a direction so as to create a south magnetic pole at coil 504. Since open end 490 of outer cup 482 and free end 492 of core 484 are both south poles, with coil 504 being a south pole, coil 504 is repelled upwardly, away from the south poles, since like magnetic poles repel each other. Simultaneously the north poles of closed end 486 of magnet 480 and adjoining end 488 of core 484 attract coil 504 upwardly since opposite magnetic poles attract each other. As a result thereof, coil 504 unseats intake valve 380 and raises the same against compression spring 454 until disc 498 contacts core 484, in which position intake valve 380 remains until the DC voltage ceases to be applied. When the DC voltage is no longer applied to coil 504, the magnetic field of coil 504 ceases and compression spring 454 urges intake valve 380 to reseat against seat 348 to stop the flow of pressurized fluid into the respective cylinder. It should be noted that the respective north and south poles of permanent magnet 480 and coil 504 can both be reversed such that solenoid 450 still actuates in the proper direction to unseat intake valve 380.

When solenoid 450 is used in exhaust valve and solenoid assembly 42, compression spring 454, acting against coupling 456 and cylinder head upper plate 34*a*, biases disc 498 with stem 460 upwardly such that exhaust valve 420 fully contacts seat 354 of cylinder head bottom plate 34*b* so as to provide a good seal therewith, and disc 498 does not contact center core 484 free end 492. In this case, solenoid 450 is operated by applying a DC voltage through coil 504 such that current flows in the direction opposite that of exhaust valve and solenoid assembly 40 so as to create a north magnetic pole at coil 504. Since open end 490 of outer cup 482 and free end 492 of core 484 are both south poles, with coil 504 being a north pole, coil 504 is attracted downwardly, toward the south poles, since opposite magnetic poles attract each other. Simultaneously the north poles of closed end 486 of magnet 480 and adjoining end 488 of core 484 repel coil 504 downwardly since like magnetic poles repel each other. As a result thereof, coil 504 unseats intake valve 420 and lowers the same against compression spring 454 until disc 498 contacts cover plate 494, in which position exhaust valve 420 remains until the DC voltage ceases to be applied. When the DC voltage is no longer applied to coil 504, the magnetic field of coil 504 ceases and compression spring 454 urges exhaust valve 420 to reseat against seat 354 to stop the flow of pressurized fluid out of the respective cylinder. It should be noted that the respective north and south poles of permanent magnet 480 and coil 504 can both be reversed such that solenoid 450 still actuates in the proper direction to unseat exhaust valve 420.

Referring to FIG. 7, a preferred type of solenoid 520 is shown for use in intake valve and solenoid assembly 40 and exhaust valve and solenoid assembly 42. In solenoid 520, permanent magnet 480 is replaced with an arcuate, bar-type permanent magnet 522. Magnet 522 has a vertical center portion 524 and a horizontal portion 526 both preferably of circular cross-section, with horizontal portion 526 having a band 528 preferably of rectangular cross-section. The vertical center portion 524, and the horizontal portion 526 with band 528, are comparable to free end 492 of core 484, and open end 490 of outer cup 482, respectively. Vertical portion 524 is a magnetic north pole, while horizontal portion 526 including band 528 is a magnetic south pole. Cover plate 494 with central aperture 496 is affixed to band 528 by means such as glue or screws (not shown). All of the remaining parts are the same as and function as in solenoid 450.

Solenoid 520 is operated in the same manner as solenoid 450 is, by applying a DC voltage through coil 504 such that current flows in a direction so as to create either a north or a south magnetic pole at coil 504. When the voltage is applied so as to make coil 504 a south magnetic pole, as for use in intake valve and solenoid assembly 40, coil 504 is repelled by horizontal portion 526 with ring 528, since they are both south magnetic poles, and is attracted to vertical portion 524, since it is a north magnetic pole. As a result thereof, coil 504 moves in an upward direction to open intake valve 380. When the voltage is applied such that the current in coil 504 flows in the opposite direction, as for use in exhaust valve and solenoid assembly 42, coil 504 is a north pole and moves in the downward direction to open exhaust valve 420. As before, it should be noted that the respective north and south poles of permanent magnet 522 and coil 504 can both be reversed such that solenoid 520 still actuates in the proper direction in the particular application.

FIG. 8 shows engine block 20 with cylinders 22 and 24, pistons 36, and piston rods 38 and 62. Timing gear 92 meshes with timing gear racks 50 and 64 to maintain pistons 36, with respective piston rods 38 and 62, in an opposing orientation. Rollers 104 disposed on shoulder bolts 106 bear against piston rods 38 and 62 to maintain timing gear racks 50 and 64 in mesh with timing gear 92, while plate 100 maintains piston rods 38 and 62 against cylinder block offset section 20*a*. Conductive intake valve actuation plates 540, 542, and 544 along with conductive exhaust actuation plate 546 are conductively affixed to each of piston rods 38 and 62 such as by soldering, brazing, welding, or screws (not shown).

As will be explained subsequently, the engine electrical system uses direct current (DC) supplied by a battery, with engine block 20 being negatively grounded, and with some or all of the major internal engine components being electrically conductive such that piston rods 38, 62, and 72 are also negatively grounded. Electrical current flows from piston rods 38, 62, and 72 through actuation plates 540, 542, 544, and 546, through a plurality of switches 548, to activate the respective intake valve and solenoid assemblies 40 and exhaust valve and solenoid assemblies 42.

FIGS. 9 and 9A show an electrical box 549, electric switches 548, and piston rod 62. Each electric box 549 fits into an access aperture 550 in cylinder block 20 for each of power units 32, 60, and 70, and holds electrical switches 548. Box 549 has a rectangular tubular body 551, and an access cover 552. Tubular body 551 is affixed to cylinder block 20 such as by adhesives, pressfit, or screws (not shown), and cover 552 is held to box 549 and cylinder block 20 such as by pressfit or screws (not shown). A wire bundle 553 enters box 549 through a grommet 554 which is disposed in an aperture 555 in cover 552. Tubular body 551 has internally facing upper and lower flanges 556 and 557, respectively, to which electrical switches 548 are attached.

Each switch 548 comprises an electrically conductive, spring steel, actuation bar 558, which has a connection end 559 and a contact end 560. Actuation bars 558 each have a conductive wheel 561 which has a coaxial aperture 562 therethrough through which a generally U-shaped conductive axle 563 is conductively disposed, with axle 563 being conductively affixed, such as by soldering, welding, or brazing, to contact end 560 of actuation bar 558. Each of actuation bars 558 are positioned parallel to and spaced from their respective actuation plate 540, 542, 544, and 546 at such a spacing that wheels 561 contact the respective actuation plate, but do not directly contact the respective piston rod 38, 62, or 72 during engine operation. An electrically non-conductive cover 564 is disposed over switches 548. Cover 564 overlaps upper and lower flanges 556 and 557 and is removably held thereto such as by screws 566 and 567. Actuation bars 558 are held in position by cover 564 against lower flange 557, between insulating strips 568, one of which is also disposed between cover 564 and upper flange 556. Insulating strips 568 may be slightly resilient so as to sandwich connection end 559 of actuation bars 558 between cover 564 and lower flange 557 so as to electrically isolate each of actuation bars 558 therefrom. Insulating strip 568 may have molded-in grooves (not shown) to assist in the alignment of actuation bars 558 during electrical switch assembly. Cylinder block 22 is negatively grounded in a direct current (DC) electrical system such that piston rods 38, 62, and 72 along with actuation plates 540, 542, 544, and 546 also carry a negative charge. An electrical wire such as 570 of wire bundle 553 is connected, such as by soldering, to the connection end 559 of each actuation bar 558 such that an electrical connection is made between each piston rod 38, 62, and 72 through the respective actuation plates 540, 542, 544, and 546, wheel 561, axle 563, actuation bar 558, and wire 570 whenever the respective actuation plate is beneath the respective wheel 561.

A metal or plastic thumb screw 572 is threadably disposed through a threaded aperture 574 in cover 564 adjacent each actuation bar 558. Actuation bars 558, due to their resilient spring quality, bear against the tip of the thumb screws 572 such that the contact end 560 of each of actuation bars 558 can be adjusted relative to the respective actuation plates 540, 542, 544, and 546 by turning thumb screws 572 in or out relative to actuation bars 558. The proper contact and clearances between wheels 561 and the respective actuation plate 540, 542, 544, and 546, and the respective piston rods 38, 62, and 72 is thus assured. Note that while grease or oil will splatter onto the actuation plates 540, 542, 544, 546, wheels 561, axles 563, and actuation bars 558, the current will be driven by a sufficient DC voltage to conduct through the oil film between the respective parts.

Referring to FIG. 10, first drive shaft 180 and second drive shaft 181 extend through webs 186 and 192, respectively, and are supported by bearings 182. Bearings 182 are retained to their respective webs 186 and 192 such as by internal retaining rings (not shown) and first and second drive shafts 180 and 181 are retained from longitudinal movement such as by external retaining rings (not shown). First and second drive shafts 180 and 181 each have a toothed drive wheel 600 affixed thereto, each of which has a plurality of longitudinally extending radial teeth 602. Drive wheels 600 are affixed to the respective first and second drive shafts 180 and 181 such as by welding, splining, external retaining rings (not shown) or by a key 604.

Clutch 260 comprises drive gear 264, a short driven wheel 606, and a long driven wheel 608, each having an aperture 610, 612, and 614, respectively. Drive gear 264 has a first counterbore 616 and a second counterbore 618 on opposite sides thereof. Short and long driven wheels 606 and 608 have pilot portions 620 and 622, respectively, each of a diameter so as to closely fit within counterbores 616 and 618, respectively, of drive gear 264. Short and long driven wheels 606 and 608 are each affixed to drive gear 264 such as by welding or brazing. A bushing 624 is pressfit within apertures 610, 612, and 614 to closely fit around first and second drive shafts 180 and 181, so as to allow clutch assembly 260 to rotate freely and slide longitudinally thereon. Short and long driven wheels 606 and 608 have longitudinally extending radial teeth 626 and 628, respectively, which are adapted to mate with teeth 602 of drive wheels 600.

Long driven gear 608 has a parking gear portion 630 having radial teeth 632, which can be selectively engaged with mating teeth 634 of a parking plate 636 which is affixed to web 192 such as by screws 638. A cutout 640 in web 192 allows radial clearance for teeth 632 of parking gear portion 630 and a spacer portion 642 allows radial clearance for teeth 634 of parking plate 636 when clutch 260 is in the reverse drive rotation position as will be explained subsequently. An actuation groove 644, defined by flanges 646 and 648 of long driven wheel 608, is disposed between spacer portion 642 and pilot portion 622 of long driven wheel 608.

The longitudinal position of clutch assembly 260 on first and second drive shafts 180 and 181 is controlled by actuator assembly 262. A clutch actuator 670 having an actuator rod 672 is mounted to cylinder block offset section 20*b* such as by a bracket 674 and screws 676. Actuator rod 672 extends through a bushing 678 in cylinder block offset section 20*a*, which bushing 678 is secured to cylinder block offset section 20*a* as by pressfitting, and into inner chamber 30*a*. A guide arm 680 comprising a rod portion 682, the end of which is disposed through a close fitting aperture 684 in actuator rod 672, and a semicircular guide ring 686 having a T-shaped cross-section which fits into actuation groove 644 and which functions to transfer longitudinal motion of actuator rod 672 to clutch assembly 260. Rod portion 682 is retained to actuator rod 672 such as by external retaining rings 688 and flat washers 690. A pair of semicircular anti-friction pads 692 are affixed to semicircular guide ring 686 such as by adhesive bonding or rivets (not shown), and acts to minimize the friction and wear to flanges 646 and 648 and to semicircular guide ring 686.

Clutch actuator 674 is preferably a geared stepping motor, though an electric solenoid, a hydraulic cylinder, a pneumatic cylinder, or other controllable actuation device which can be selectively controlled to move to four preset positions may be used. When clutch actuator 670 moves to a new position, it causes actuator rod 672, guide arm 680, and clutch assembly 260 to move to a new position and to hold it there until a new command is received. The command is sent by the user of the engine, typically on a motor vehicle, who moves a switch or valve to send an electrical, hydraulic, or pneumatic signal to clutch actuator 670, depending on the type of actuator 670.

The operation of clutch assembly 260 and actuator assembly 262 to achieve forward and reverse drive, along with the neutral and park functions is as follows. Clutch assembly 260 is closely fit coaxially about adjacent ends of first and second drive shafts 180 and 181, operatively sliding longitudinally thereon at the urging of a solenoid actuation assembly 262, to allow selective coupling of drive gear 264 to drive first and second drive shafts 180 and 181. This allows power from power units 32 and 60 to power drive gear 264 in a forward rotational direction, or power units 60 (through reversing unit 80) and 70, to power drive gear 264 in a reverse rotational direction. A neutral function allows clutch assembly 260 to rotate freely from either drive shaft, and a park function locks clutch assembly 260 from rotating.

Referring to FIG. 10, forward drive is achieved by signaling clutch actuator 670 of actuator assembly 262 to move clutch assembly 260 longitudinally on first and second drive shafts 180 and 181 toward drive shaft 180 wherein the teeth 626 of short driven wheel 606 engage teeth 602 of drive wheel 600. This causes torque from power units 32 and 60 to be transmitted through first drive shaft 180, drive gear 264, differential assembly 300, to jack shafts 289 and 290, which rotate in the forward drive rotation.

Referring to FIG. 10A, the neutral function is achieved by signaling clutch actuator 670 of actuator assembly 262 to move clutch assembly 260 longitudinally on first and second drive shafts 180 and 181 away from first drive shaft 180 until teeth 626 of short driven wheel 606 disengage from teeth 602 of drive wheel 600. In this position, neither of first and second drive shafts 180 and 181 drive assembly clutch 260, such that drive gear 264, differential assembly 300, and first and second jackshafts 289 and 290 are able to rotate freely without engine power, such as when a powered automotive vehicle is coasting.

Referring to FIG. 10B, the park function is achieved by signalling actuator 670 of actuator assembly 262 to move clutch assembly 260 longitudinally on first and second drive shafts 180 and 181 further away from first drive shaft 180 toward second drive shaft 181. In this park position, clutch assembly 260 is not powered by either of first and second drive shafts 180 and 181. The teeth 632 of parking gear portion 630 engage the teeth 634 of parking plate 636 to prevent rotation of drive gear 264, and thus differential assembly 300, and first and second jackshafts 289 and 290.

Referring to FIG. 10C, reverse drive is achieved by signaling clutch actuator 670 of actuator assembly 262 to move clutch assembly 260 longitudinally on first and second drive shafts 180 and 181 toward second drive shaft 181, wherein the teeth 628 of long driven wheel 608 engage teeth 602 of drive wheel 600. This causes torque from power unit 60 (through reversing unit 80) and 70, to be transmitted through second drive shaft 181, drive gear 264, differential assembly 300, to first and second jackshafts 289 and 290, which rotate in the reverse drive rotation. In this position, parking gear portion 630 of long driven wheel 608 is positioned in cutout 640 of web 192 so as not to restrain clutch assembly 260 from rotating in the reverse drive rotation.

In FIGS. 2C, 11, and 12, there is shown differential assembly 300, first and second jackshafts 289 and 290, and peripheral gear 302. First and second jackshafts 289 and 290 extend through webs 186 and 192, respectively, and are supported by bearings 182. Bearings 182 are retained to their respective webs 186 and 192 such as by internal retaining rings (not shown) and first and second jackshafts 289 and 290 are retained from longitudinal movement such as by external retaining rings (not shown).

Differential assembly 300 comprises a pair of mutually confronting gear wheels 700, each of which have a frustoconical gear face 702 with a plurality of teeth 704, and each of which are rotationally affixed to the respective first and second jackshafts 289 and 290 such as by welding, splining, or by keying external retaining rings.

A rotating center differential assembly 706 has a frame 708 with a central hub 710 from which a circular web 712 radially extends, and which web 712 terminates in a flange 714 carrying peripheral gear 302. Peripheral gear 302 is of a larger diameter than gear wheels 700 and of sufficient width to remain continually in mesh with drive gear 264 as clutch assembly 260 moves longitudinally along first and second drive shafts 180 and 181. Hub 710 has a central aperture 716 in which a bushing 718 is pressfit of sufficient inner diameter to closely fit around and to allow frame 708 to rotate freely on first and second jackshafts 289 and 290. A thrust bearing 744 is disposed on each side of hub 710 to absorb longitudinal loads. Web 712 preferably has at least three equally radially spaced, radially inwardly pointing, radially symmetrical trapezoidal apertures 720. Frame 708 preferably has generally cylindrical inner bosses 722 which are integral with web 712, one of which is located radially inward of each trapezoidal aperture 720, and has cylindrical outer bosses 724, which are integral with web 712 and flange 714, one of which is located radially outwardly of each trapezoidal aperture 720 and which extends to flange 714. Each pair of inner and outer bosses 722 and 724 preferably have a common radial axis which lies in a plane through the longitudinal center of web 712 and which extends from the longitudinal centerline of first and second jackshafts 289 and 290 radially outwardly, bisecting the respective trapezoidal aperture 720, through the longitudinal center of flange 714 and peripheral gear 302. An axle aperture 726, having a common longitudinal centerline with inner and outer bosses 722 and 724, extends radially inwardly through peripheral gear 302, flange 714, outer boss 724, and terminates within inner boss 722. Three frustoconical gears 728, each having teeth 730 adapted to mesh with teeth 704 of gear wheels 700, and having a central aperture 732 which extends therethrough within each of which is pressfit a bushing 734, are each disposed in a trapezoidal aperture 720 with a thrust bearing 737 at each hub thereof. An axle 736 extends through each aperture 726 of inner and outer bosses 722 and 724 and through bushing 734 of each frustoconical gear 728 so as to allow the same to freely spin. Axle 736 is held in place such as by a pin 738 extending through an aperture 740 in inner boss 722 and pressfit in an aperture 742 in axle 736. Frame 708 is held in position by gear wheels 700 abutting thrust washers 250 which are disposed on each side of hub 710, and by teeth 730 of frustoconical gears 728 meshing with teeth 704 of frustoconical gear faces 702 of gear wheels 700.

Differential assembly 300 operates by drive gear 264, which meshes with peripheral gear 302 of differential frame 708, causing center differential assembly 706 to rotate. The rotational motion is transferred by way of frustoconical gears 728 to both gear wheels 700 and to first and second jackshafts 289 and 290. If the resistance to rotation, or the load, is relatively equal on both first and second jackshafts 289 and 290, then frustoconical gears 728 will not rotate about axles 736 and both first and second jackshafts 289 and 290 will rotate at the same speed. If the load on one of first and second jackshafts 289 and 290 is greater than on the other, such as in an automotive vehicle turning a corner, the most heavily loaded of first and second jackshafts 289 or 290 (e.g. the jackshaft connected to the inside vehicle wheel) will, by way of gear wheel 700, cause frustoconical gears 728 to rotate about axles 736 such that the other gear wheel 700 and jackshaft (e.g. the jackshaft connected to the outside vehicle wheel) will rotate more quickly. Note that while a drive gear 264 of clutch assembly 260 is adapted to mesh with a peripheral gear 302 of differential assembly 300, that power transfer means other than gears such as pulleys and belts may be used, depending upon the particular application.

FIG. 13 is a schematic of an enclosed pressure fluid system 760 to power the engine, which preferably utilizes steam as the pressure fluid, such as could be used in an automotive vehicle. While the system in this example preferably uses a liquid such as water, other liquids which condense in a temperature range above ambient air temperature and vaporize below the combustion temperature of the heating fuel may be used. The system consists of a pressurized fluid reservoir 762 which contains liquid under pressure. While system 760 in normal use is a closed system, liquid may need to be added from time to time through an inlet 764. A bleed valve 766 allows bleed off of the pressure in system 760 prior to adding liquid. Liquid is conducted from an outlet 767 of reservoir 762, which may have a filter (not shown) to remove impurities, through a conduit 768 to an inlet 770 of a flash boiler 772. The liquid is rapidly heated therein by a heater 774 to convert the liquid to a pressurized vapor of, for example, steam at about 600 PSI gauge and about 750 degrees Fahrenheit to 800 degrees Fahrenheit. Heater 774 is supplied with a liquid or gaseous fuel, for example a low grade hydrocarbon fuel such as kerosene or natural gas, which is contained in a fuel tank 776 and conducted thereto by a conduit 778. Fuel tank 776 may be refillable by the user as by a fuel inlet 780 and a valve 782. The pressure and temperature inside flash boiler 772 can be monitored by a pressure gauge 784 and a temperature probe 786, respectively. The vaporized liquid comprising the pressure fluid is channeled through an outlet 788 of flash boiler 772 through an insulated conduit 790 to a throttle valve 792. Throttle valve 792 may be mechanical or electrically actuated and is comparable to the throttle on a gasoline type automotive vehicle. Preferably the valve is linked mechanically or electrically to a automotive-type accelerator pedal 793. The throttled pressure fluid exiting throttle valve 792 is at a lower pressure than in flash boiler 772 and is conducted through an insulated conduit 794 into an insulated intake manifold 796 which leads the pressure fluid into the individual cylinders of the engine. The pressure fluid is expanded inside the cylinders of the engine to extract work therefrom, and exits through an exhaust manifold 798. The exiting pressure fluid, may be partially condensed and, at lower pressure, fed through a conduit 800 and a check valve 802, to prohibit flow back toward the engine. The pressure fluid is fed through a conduit 804 and through a condenser coil 806 wherein the remaining pressure fluid is condensed into a liquid. An electric or mechanically driven fan 808, or other means, may be utilized to blow ambient air over coil 806 to assist in the removal of heat from the pressure fluid. The condensed, low pressure liquid is fed through a conduit 810 by an electrically or mechanically driven pump 812 and boosted back up to a pressure slightly higher than the pressure in reservoir 762 of, for example, 600 PSI gauge. The pressurized liquid is fed through a conduit 814 through a check valve 816, which prevents backflow of liquid should pump 812 stop pumping, and through a conduit 818 into inlet 820 of reservoir 762.

FIG. 14 is an electrical schematic diagram for the invention as illustrated in FIGS. 1–14. The electrical system 850 consists of electrically operated solenoids 450, a pair thereof for each power units 32, 60, and 70. Likewise, each cylinder has a set of four switches 548, three for each of solenoids 450 to actuate the intake valves (not shown) and one for each of solenoids 450 to actuate the exhaust valves (not shown). The system is preferably powered by a battery 852, which negatively grounds engine block 20 (not shown) and the associated metal internal and external components. A main ignition switch 854 connects and disconnects the positive connection of battery 852 with the rest of the electrical circuit. Switches 548 are negatively grounded to the engine block 20 through the respective piston rod 38, 62, and 72, and intermittently open and close based on the position of each piston and piston rod (not shown) in the respective cylinder. Each of switches 548 is connected to a five tier switch 856 which has five individual tiers 858, 860, 862, 863, and 864, each of which tier has a contact for park, reverse, neutral, and drive one through drive four. Pivoting contact bars 866, 868, 870, 871, and 872, are mechanically, but not electrically, connected together such that when switch 856 is turned to a particular position, by use of a common switch lever (not shown), for example to the drive one position, all of the respective contact bars on all of the respective tiers are contacting the respective drive one contact. The respective contacts of tiers 860, 862, and 863 have their respective contact bars 868, 870, and 871 connected directly to negative ground. Tiers 858 and 864 have their respective contact bars 866 and 872 connected to the negative input lead of the respective solenoids 450. The contacts for tier 860 are connected to clutch actuator 670 to the respective negative contact thereof for the particular forward and reverse drive and the neutral and park functions. Only the drive four contact of tier 862 is connected to a solenoid 450 connected to an exhaust valve (not shown). The positive side of electrical system 850 is connected from ignition switch 854 to the positive input of clutch actuator 670 and to a rotor 874, of an electrical distributor 876, which rotor is mechanically or electrically synchronized with the position of the pistons and piston rods of the first and second power units such that for each completed pair of intake and exhaust strokes there is one rotation of rotor 874. Such synchronization can by accomplished by conventional means such as a gear pair, one of which engages each of drive gear racks 52 and 66, which drive a pair of one-way ratchet mechanisms, which drive distributor rotor 874. The gear ratios and ratchet mechanism being sized such as to drive rotor 874 one complete revolution for each completed intake/exhaust stroke of the respective power unit. A pair of semicircular conductive outer contacts 878 and 880 are arrange for intermittent contact by rotor 874 for about half of a rotation each of rotor 874. Outer contacts 878 and 880 are connected to the positive input of the appropriate solenoids 450 which actuate the intake and exhaust valves (not shown). The function of distributor 876 is to allow asymmetrical actuation of the respective intake and exhaust valves by solenoids 450 based on the symmetrical actuation of switches 548 by the respective actuation plates. Note that conventional electronics can be used in place of distributor 876 to achieve the same function electronically.

An alternate embodiment of the invention as used for an automotive vehicle is shown in FIG. 15, which embodiment has a cylinder block 900 having an offset section 900*a* housing first and second power units 32 and 60, and an extended offset section 900*b* which houses third power unit 70 and a fourth power unit 902. Fourth power unit 902 replaces reversing unit 80 and coupling system 150 (FIG. 3) to power second drive shaft 181. This embodiment does not require all four power units 32, 60, 70, and 902 to run during forward and reverse engine functions, but rather only requires power units 32 and 60 to run in the forward drive rotation and power units 70 and 902 in the reverse drive rotation, with the other two power units idle.

As can be seen best in FIG. 16, adding power unit 902 requires several changes besides changing to cylinder block 900 and adding fourth power unit 902. The replacement of the small timing gear 108 by larger timing gear 92 is necessary to provide the spacing necessary to provide a full cylinder 904 in place of smaller cylinder or chamber 28. Likewise plate 112 is replaced by plate 100 for the same reason. Additional parts added include a piston 36, piston bracket 44, pin 48, intake valve and solenoid assembly 40, and exhaust valve and solenoid assembly 42. Power unit 902 functions the same as the other power units 32, 60, and 70.

The alternate embodiment engine requires a slightly modified electrical system as shown in FIG. 17. Electrical system 930 has an additional two solenoids 450, one to actuate the intake valve (not shown) and one to actuate the exhaust valve (not shown) for fourth power unit 902. Only a pair of electrical switches 548 are utilized on fourth power unit 902 for the intake valve (not shown) as intake durations of twenty and thirty percent are not required for reverse engine rotation. A second electrical distributor 932 comprising rotor 934, and semicircular outer contacts 936 and 938, which rotor is synchronized with the third power unit and the reversing unit so as to function for the reverse power units 70 and 902 as does distributor 876 for the first and second power units. Outer contacts 934 and 936 are connected to the positive input of solenoids 450 for the respective intake and exhaust valves. A seven tiered switch 940 which has individual tiers 942, 943, 944, 945, 946, 948, and 950, each of which tier has a contact for park, reverse, neutral, and drive one through drive four. Pivoting contact bars 952, 953, 954, 955, 956, 958, and 960 are connected mechanically, but not electrically, and operate in a similar manner to five tiered switch 856 (FIG. 14) such that when switch 940 is turned to a particular position, by use of a common switch lever (not shown), all of the respective contact bars on all of the respective tiers are contacting the respective drive contact.

In the forgoing embodiments of the engine, power is supplied to first or second jackshafts 289 and 290 only when the power units are acting to rotate the roller clutches more quickly than the respective drive shaft is rotating at a particular vehicle speed. Since the roller clutch is free wheel when not being powered by the respective power unit, the power units do not act to slow the jackshafts as they would in other powered vehicles. This condition is called "freewheeling", when the automotive vehicle is coasting without any engine drag of the piston and cylinder power units to slow the vehicle, and may be illegal in some states. If the engine is used in an automotive application in such a state, a system to add rolling resistance to the jackshafts or drive shafts while coasting may be added. For example, a hydraulic system comprising a hydraulic pump, piping, and an oil reservoir may be added which can be connected to one or both jackshafts by means of a clutch device. A control system which activates the pump when the vehicle is coasting can be used to automatically add drag to slow the automotive vehicle during coasting to be in compliance with the particular state law.

While the forgoing embodiments are shown and described particularly for automotive use, it should be realized that essentially similar embodiments could be used in any application requiring reverse power output. In such uses, as in automotive use, there will be separate power output shafts for the engine to accommodate both forward and reverse drives. In instances in which reverse drive is not required such as to power machines or other fixed or mobile equipment, a single power output drive shaft for the engine is utilized. In such case, a clutch assembly without the reverse drive and possibly the park function can be utilized similar to that for automotive vehicles.

The clutch system and the differential system heretofore described in detail were designed especially for use with the engine of the present invention as heretofore disclosed, but it is realized that such clutch system and such differential system can be used in connection with other engines and therefore constitute subcombination inventions in their own right as claimed herein.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A pressure fluid driven engine, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches interconnected with said power units and said drive shaft so as to power said drive shaft unidirectionally;

operating means for opening and closing the intake and exhaust valves of said power units; and means for variably controlling the extent of time that said intake valves are open.

2. A pressure fluid driven engine, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches interconnected with said power units and said drive shaft so as to power said drive shaft unidirectionally;

operating means for opening and closing the intake and exhaust valves of said power units;

means for controlling the extent of time that said intake valves are open;

a third intake and exhaust valved, piston and cylinder power unit;

a reversing unit, said third power unit and said reversing unit being oppositely acting, respectively, and provided with timing means to maintain the opposing operating relationship, said third power unit and said reversing unit being longitudinally displaced from the first and second power units and on the opposite side of the drive shaft therefrom;

a second drive shaft for power output, coaxial with the first drive shaft;

a second pair of roller clutches, which lock in the opposite rotational direction from the first pair and are interconnected with said third power unit, with said reversing unit, and with said second drive shaft so as to drive said second drive shaft unidirectionally in the rotational direction opposite that of the first drive shaft;

operating means for opening and closing the intake and exhaust valves of said third power unit;

means for controlling the extent of time that said intake valve of said third power unit is open;

means for selectively outputting power from said first and second drive shafts so as to selectively power a device in either rotational direction; and synchronizing means for connecting the first or second power unit with the third power unit so as to maintain said third power unit and said reversing unit operating in a timed relationship with respect to said first and second power units and to transfer power from said first or second power unit to said third power unit.

3. An engine according to claim 2, further comprising each of the first and second pair of roller clutches having a driven portion with a pinion gear, the piston of the first, second, and third power units each having an elongate piston rod and the reversing unit having an elongate piston rod, each of said piston rods carrying longitudinally thereof a first gear rack in mesh with the pinion gear of the corresponding roller clutch of said first and second pair of roller clutches.

4. An engine according to claim 3, wherein the operating means for opening and closing the intake valves and exhaust valves comprise, for each power unit, an electric solenoid operatively connected to said intake valve of the corresponding power unit, and wherein the control means for determining the extent of time each of said intake valves is open comprises a plurality of actuation plates of predetermined lengths affixed to and extending longitudinally of the piston rod of the corresponding power unit, said plates having lengths corresponding to the portions of the intake stroke during which each of said intake valves is to be open, and said control means further comprising a plurality of switches arranged to engage the respective actuation plate during a portion of the travel of the corresponding piston during its intake stroke, and said switches being selectively controllable for determining which switch is operatively connected to the respective intake valve solenoids at any given time.

5. An engine according to claim 3, wherein the operating means for opening and closing the intake and exhaust valves comprise for each power unit, an electric solenoid operatively connected to said exhaust valve of the corresponding power unit, and wherein the control means also controls the extent of time said exhaust valve is open, further comprising an actuation plate of predetermined length affixed to and extending longitudinally of the piston rod of the corresponding power unit, said plate having a length corresponding to the portion of the exhaust stroke during which said exhaust valve is to be open, and a switch arranged to engage said actuation plate during a portion of the travel of the corresponding piston during its exhaust stroke, said switch being operatively connected to the respective exhaust valve solenoid.

6. An engine according to claim 3, wherein the timing means for maintaining the opposing operating relationship of the first and second power units, respectively, and the third power unit and the reversing unit comprises each of the elongate piston rods of said power units and of said reversing unit longitudinally carrying a second gear rack, said second gear racks of each of the first and second power units, respectively, and of said third power unit and said reversing unit facing one another, and a pair of timing gears, one each disposed between and adapted to mesh with said second gear racks of said first and second power units, respectively, and of said third power unit and said reversing unit, so as to maintain the respective pistons and piston rods thereof in the opposed operating orientation.

7. An engine according to claim 3, wherein the synchronizing means includes a flexible cable having a first end connected to a lower end of the piston rod of the first or second power unit, a second end of said cable connected to a lower end of the piston rod of the third power unit, and a plurality of pulleys in an operative relationship with said flexible cable such that when said piston rod having said first cable end attached descends during a power stroke of said first or second power unit, said flexible cable acting through said pulleys raises said piston rod of said third power unit in an exhaust stroke so as to maintain said third power unit and the reversing unit running in a synchronized manner with said first and second power units.

8. An engine according to claim 2, wherein the intake valve of each power unit comprises an inverted, cup-shaped body portion having a bottom and an open end, with a concentric, elongate rod extending upwardly from said bottom, said body portion being slidably disposed in an intake port for the respective power unit in a cylinder head of said engine and having a plurality of pressure-equalizing intake orifices in the bottom of said body portion, a plate surrounded by and defined by a plurality in passageways of said cylinder head is perpendicularly disposed in said intake port of the respective power unit so as to provide a seat for said open end of said body portion to selectively allow inflow of gases into the respective power unit, said pressure equalizing apertures acting to balance the pressure on each side of said body portion bottom to minimize the actuation force of said intake valve.

9. An engine according to claim 2, wherein the exhaust valve of each power unit comprises a disc with a concentric, elongate, upwardly extending rod, said disc having a tapered outer rim which fits into a mating seat about an exhaust port of the corresponding power unit.

10. An engine according to claim 2, wherein the selective power output means comprises first and second coaxial jackshafts, having a driven gear coaxially disposed thereon and operatively connected thereto, said first and second jackshafts mounted for rotation parallel to the first and second drive shafts, a drive gear coaxially disposed about adjoining ends of said first and second drive shafts and adapted to move longitudinally about adjoining ends of said drive shafts, said drive gear adapted to mesh with said driven gear, said driven gear being of a sufficient width to remain continually in mesh with said drive gear during lateral movement of said drive gear, clutch means adapted to selectively couple said drive gear to said first or second drive shaft, or to neither of said drive shafts, upon movement of said drive gear, so as to provide a forward, a reverse, and a neutral engine function, respectively, and said clutch means operated by an actuation means.

11. An engine according to claim 10 further including locking means to prevent rotation of the drive gear while the clutch is in a park position, so as to provide a park function, and wherein the actuation means to operate said clutch includes a collar having an annular groove and mounted for rotation with said drive gear, an actuation arm having a forked end which slidably engages said grooved collar, said actuation arm having a distal end from said fork which is coupled to a multiple position actuator so as to allow selective positioning of said collar and said drive gear to provide the forward, reverse, neutral, and park engine functions.

12. An engine according to claim 10, wherein the first and second jackshafts each are adapted at a distal end from the other to drive a vehicle wheel, and wherein the operative connection of the driven gear to each of said first and second jackshafts is through a differential means so as to permit independent rotation of the respective first and second jackshafts with said wheels.

13. An engine according to claim 12, wherein the differential means comprises:

a pair of gear wheels, each having a frustoconical gear face with a plurality of teeth, one gear wheel coaxially, rigidly affixed to each jackshaft adjacent proximate ends thereof with said frustoconical gear faces mutually confronting;

a center differential assembly having a frame comprising a central hub, a circular web extending radially therefrom, and a peripheral flange, said hub and frame rotatably mounted on the proximate ends of said jackshafts between said confronting gear faces of said gear wheels, said frame having the driven gear disposed thereon to be driven by the drive gear, and three equally radially spaced trapezoidal apertures through said web, in each of which is rotatably disposed a frustoconical gear having teeth adapted to simultaneously mesh with said teeth of both of said frustoconical gear faces; and said drive gear driving said driven gear such that said frame with said frustoconical gears rotate about the axis of said first and second jackshafts with the teeth thereof in mesh with said teeth of said frustoconical gear faces so as to rotate and power said gear wheels, jackshafts, and vehicle wheels while allowing the same to rotate independently of the other and at a different rotational speed therefrom through rotation of said frustoconical gears about their axis.

14. A pressure fluid driven engine, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches interconnected with said lower units and said drive shaft so as to power said drive shaft unidirectionally;

operating means for opening and closing the intake and exhaust valves of said power units;

means for controlling the extent of time that said intake valves are open;

third and a fourth intake and exhaust valved, piston and cylinder power units oppositely acting, respectively, and provided with timing means to maintain the opposing operating relationship, said third and fourth power units being longitudinally displaced from the first and second power units and on the opposite side of the drive shaft therefrom;

a second drive shaft for power output coaxial with the first drive shaft;

a second pair of roller clutches, which lock in the opposite rotational direction from the first pair and are interconnected with said third and fourth power units, and with said second drive shaft so as to drive said second drive shaft unidirectionally in a rotational direction opposite that of the first drive shaft;

operating means for opening and closing the intake and exhaust valves of said third and fourth power units;

means for controlling the extent of time that said intake valves of said third and fourth power units are open; and means for selectively outputting power from said first and second drive shafts, so as to be able to selectively power a device in either rotational direction.

15. A pressure fluid driven engine with a clutch and actuator, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches interconnected with said power units and said drive shaft so as to power said drive shaft unidirectionally;

operating means for opening and closing the intake and exhaust valves of said power units;

means for controlling the extent of time that said intake valves are open;

a drive wheel coaxially, affixed to the drive shaft inwardly of a free end thereof, so as to rotate therewith, said first drive wheel having a plurality of longitudinally extending, radial teeth facing said free end of said first drive shaft;

a clutch, coaxially disposed on said free end of said first drive shaft, said clutch adapted to slide longitudinally on and rotate independently of said first drive shaft, said clutch including an integral power output means adapted to transfer power from said clutch to said machine or vehicle to be powered, and a first driven wheel having a plurality of longitudinally extending radial teeth facing said first drive wheel and adapted to mate with said teeth of said first drive wheel; and actuator means for positioning said clutch in a forward drive position, wherein said teeth of said first drive wheel engage said teeth of said first driven wheel so as to output power from said drive shaft of the power units to power the machine or vehicle, and in a neutral position wherein said teeth are disengaged so as not to output power from said drive shaft of said power units to power the machine or vehicle.

16. An engine according to claim 15, further comprising:

a second drive wheel coaxially affixed to a second drive shaft of the engine, inward of a free end thereof, so as to rotate therewith, said second drive wheel having a plurality of longitudinally extending radial teeth facing said free end of said second drive shaft, said first and second drive shafts being coaxial;

said clutch also being coaxially disposed on said free end of said second drive shaft, intermediate said drive wheels, said clutch also adapted to slide longitudinally thereon and able to rotate independently of said second drive shaft, with a second driven wheel facing said second drive wheel and having a plurality of longitudinally extending radial teeth adapted to selectively engage said teeth of said second drive wheel;

locking means to prevent rotation of the clutch assembly while the clutch is a park position, so as to provide a park function; and the actuation means having a park position wherein said rotating clutch assembly is positioned such that said teeth of said first and second driven wheels of said clutch assembly are disengaged from the teeth of the respective drive wheels and said clutch is prevented from rotating by said locking means, and a reverse drive position wherein the teeth of said second drive wheel engage with the mating teeth of said second driven wheel to power the machine or vehicle in a reverse drive direction.

17. An engine device according to claim 16, wherein:

the integral power output means of the clutch assembly comprises a gear coaxially disposed on the clutch assembly between the first and second driven wheels and adapted to mesh with a mating gear of the powered machine or vehicle to power the same;

said clutch assembly includes an annular actuation groove defined by concentric flanges and includes a parking gear having radially extending teeth which can be selectively engaged with mating teeth of a parking plate affixed to the engine; and the actuation means includes an actuation arm having a semicircular end which is disposed in said actuation groove between said flanges, said actuation arm having a distal end from said fork which is coupled to a positionable actuator rod of a four-position actuator affixed to said engine such that when said actuator rod moves said actuation arm moves said clutch longitudinally so as to allow selective positioning of said clutch assembly to provide the forward and reverse drives, and the neutral and park functions.

18. A pressure fluid driven engine with a differential device, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches interconnected with said power units and said drive shaft so as to power said drive shaft unidirectionally;

operating means for opening and closing the intake and exhaust valves of said power units; and means for controlling the extent of time that said intake valves are open;

a pair of gear wheels, each having a frustoconical gear face with a plurality of teeth, one gear wheel coaxially affixed to each jackshaft adjacent proximate ends thereof with said frustoconical gear faces mutually confronting;

a center differential assembly having a frame comprising a central hub, a circular web extending radially therefrom, and a peripheral flange, said hub and frame rotatably mounted on the proximate ends of said jackshafts between said confronting gear faces of said gear wheels, said frame having an integral power input means adapted to be driven by said drive shaft of said engine disposed about said peripheral flange, and three equally radially spaced trapezoidal apertures through said web, in each of which is rotatably disposed a frustoconical gear each having teeth adapted to simultaneously mesh with said teeth of both of said frustoconical gear faces; and said drive shaft of said engine driving said differential power input means, such that said frame with said frustoconical gears rotate about an axis of said first and second jackshafts with the teeth thereof in mesh with said teeth of said frustoconical gear faces to transfer power from said drive shaft to the respective said gear wheels, jackshafts, and vehicle wheels while allowing the respective sets of jackshafts with wheels to rotate independently of the other and at a different rotational speed therefrom by rotation of said frustoconical gears about their axes.

19. An engine according to claim 18, as part of a power drive system for a vehicle, wherein:

the frustoconical gears each have a central aperture coaxially disposed therethrough with a bushing affixed therein;

the frame power input means comprises the peripheral flange having an outer gear with teeth, said teeth being adapted to mesh with teeth of a drive gear of the drive shaft of the engine;

the frame having pairs of inner and outer bosses, disposed on opposite sides, respectively, of each trapezoidal aperture with each pair having a common center axis, a coaxial axle aperture extending through the peripheral flange, each outer boss, and partially through each inner boss of said pairs of bosses;

an axle disposed within said axle aperture and frustoconical gear bushing, and retained therein by retaining means.

20. A method of accommodating varying power needs of a positive displacement, pressure fluid powered, piston and cylinder engine having pairs of oppositely acting piston and cylinder power units coupled to respective roller clutches and an output drive shaft, comprising varying quantity of pressure fluid introduced into the cylinders of said engine between a minimum and a maximum quantity from time to time depending upon the torque needs of the engine and regardless of the speed of the engine.

21. A pressure fluid driven engine, comprising:

a pair of intake and exhaust valved, piston and cylinder power units that are oppositely acting, respectively, and provided with timing means to maintain the opposed operating relationship;

a power output drive shaft for said pair of power units;

a pair of roller clutches directly interconnecting said power units and said drive shaft so as to power said drive shaft unidirectionally; and operating means for opening and closing the intake and exhaust valves of said power units.

* * * * *